US005597335A

United States Patent [19]

Woodland

[11] Patent Number: 5,597,335

[45] Date of Patent: Jan. 28, 1997

[54] MARINE PERSONNEL RESCUE SYSTEM AND APPARATUS

[76] Inventor: Richard L. K. Woodland, 581 Broadway St., Victoria, British Columbia, Canada

[21] Appl. No.: 544,460

[22] Filed: Oct. 18, 1995

[51] Int. Cl.[6] ..... B63B 7/00

[52] U.S. Cl. ..... 441/36; 441/38; 441/40; 441/83; 114/345; 114/348

[58] Field of Search ..... 441/11, 12, 13, 441/20, 35, 36, 37, 38, 39, 40, 80, 83, 87, 89, 129; 114/344, 345, 361, 348, 349, 68

[56] References Cited

U.S. PATENT DOCUMENTS

| | | | |
|---|---|---|---|
| 3,037,218 | 6/1962 | Brooks III | 441/38 |
| 3,092,854 | 6/1963 | Manhart | 441/38 |
| 3,222,700 | 12/1965 | Smith | 441/38 |
| 3,883,913 | 5/1975 | Givens | 441/38 |
| 4,001,905 | 1/1977 | Givens | 441/38 |
| 4,533,333 | 8/1985 | Andrew et al. | 441/38 |
| 4,545,319 | 10/1985 | Ferronniere | 441/40 |

*Primary Examiner*—Stephen Avila
*Attorney, Agent, or Firm*—Roddy M. Bullock

[57] ABSTRACT

The present invention provides for an air, sea, or land deployed rapid response, self-propelled, autonomous or semi-autonomous marine vehicle (AMV) possessing a pair of extendible hydraulic cylinders encased in a pneumatic inflation chute, with an ability to be directed toward, and to autonomously seek out and recover physically restricted persons in peril from an aqueous environment. The AMV uses video, thermal, and audio sensors to actively and autonomously detect persons floating in an aqueous environment, and can be directed to a person or persons in distress on the sea surface through an aircraft, ship, or shore mounted, GPS linked, laser targeting system. The present invention also possesses the ability to provide life support functions, propulsive mobility, and two way real-time radio frequency and satellite based voice, video and data telemetry with the rescue aircraft, ship, or shore based coordination center responsible for deploying, operating, or monitoring the AMV.

23 Claims, 27 Drawing Sheets

MARINE PERSONNEL RESCUE SYSTEM AND APPARATUS

FIELD OF THE INVENTION

This invention relates to personnel rescue systems used in time sensitive emergency marine, lake, and river rescue applications and more particularly to such rescue applications which comprise a personnel detection, targeting, and vehicle control system, a rapid air, sea, or land deployment system, an autonomous vehicle, the system designed to detect, retrieve, provide life support, and transport marine disaster victims to safe haven and ultimate recovery.

BACKGROUND OF THE INVENTION

Every year several thousand people drown worldwide. These deaths are in many instances the result of exhaustion, dehydration, and hypothermia induced loss of coordination and consciousness which results in drowning. In other instances where survival is not affected by lower temperatures, the task of locating, assisting, and otherwise recovering persons in peril from an aqueous environment can be compounded by inclement weather, and environmental obstacles like fire, ice, or smoke which make approach to a potential drowning victim perilous to the life of the rescuer.

These issues are further compounded by existing rescue methodology which employs the use of humans to effect recovery of an individual either by swimming to a person in peril, or depending on the person in peril to swim to the rescue platform. All too often the person in peril has neither the strength or the coordination to swim to an air deployed life raft, or a rescue basket lowered from a helicopter, or ship. Therefore, current methodology is not always effective as the rescue swimmer cannot be jeopardized in potentially lethal ocean conditions which could result in the loss of his own life.

Existing helicopter extraction and recovery systems are human dependent and pose a serious risk to the life of the crew and/or rescue swimmer in rough seas, high winds, fire, toxic fumes, poor visibility, or hostile weapons fire in military situations which could affect the safety of the entire helicopter crew. An example of such a system is taught in Pelas U.S. Pat. No. 5,086,998 that teaches a scoop-like net positioned below a helicopter. The Pelas invention may be effective in relatively calm seas and otherwise safe flying conditions, but it could not be used in rough seas or in the vicinity of toxic fumes, fire, high winds, or weapons fire without extreme danger to the victim and rescue crew.

A second area central to existing water based rescue methodology depends on fixed wing air transport to drop life rafts and supplies to persons to be rescued. Although the initial response time and delivery capability of search and rescue (SAR) based patrol aircraft have reached efficient levels of service, the aircraft are still hindered by a lack of targeting, precision deployment, and mobility control over the survival packages they deploy. Often the dropped life rafts, once inflated, simply get blown away in high winds, thereby becoming out of reach of the drowning persons.

Various other shortcomings of marine rescue systems exist in the areas of deployment of the rescue craft, and detection and targeting of the victims. For example, existing air deployment systems are not compatible with externally mounted aircraft and helicopter bomb racks that would make air deployment efficient. As well, existing air, land, and sea deployed rescue systems do not posses an accurate targeting system to direct a self-propelled liferaft or self propelled lifeboat package to a shipwreck survivor or other person to be rescued. Where ship and oil rig deployed self propelled lifeboats are used, they are neither semi or fully autonomous, possessing the capability to use sensors and artificial intelligence to assist in locating persons in peril. Existing life rafts and self propelled lifeboats do not possess a self homing GPS capability to guide them to safe haven to facilitate occupant removal. Existing life rafts do not have the capability to use real-time two way video, audio, informational data, search communications, and telemetry systems to administer direct remote control capability over the liferaft's or lifeboat's activities. Existing life rafts and lifeboats do not possess an autonomous self preservation collision and obstacle avoidance system utilizing radar, audio, and sonar based proximity warning sensor devices.

Even if a life raft or life boat successfully reaches the person or persons to be rescued, an additional problem is encountered in getting the victims into the raft or boat. Existing life rafts, lifeboats, and rescue systems do not possess a robotic recovery assistance capability to extract individuals suffering extreme loss of physical strength or motor coordination caused by fatigue or hypothermia.

Various other hazards exist for the life raft or boat itself. Existing life rafts and lifeboats, for example, are not fireproof, making them extremely dangerous for use in the vicinity of burning vessels or equipment. For example, the recent British Trent disaster off Belgium was a ship collision in which the crew members burned to death because rescue could not be effected because life rafts could not traverse through burning oil surrounding the ship. Existing life rafts, due to a lack of propulsive directional control, can be unstable in rough seas due to an inability to steer themselves into or away from the wind in order to accommodate high sea states which threaten to swamp or capsize the liferaft. Once capsized, existing liferaft systems also lack an automated self-righting system.

In the event of a successful rescue, there is the additional problem of sustaining the victims until further assistance can be provided. Under the limitations of current air sea or land deployed liferaft survival packages, shipwreck victims frequently die because basic requirements for survival and recovery are not met. For example, existing air deployed life rafts do not possess life raft generated heat, and desalinated water for life support. Existing life rafts do not have the capability to use real-time two way video, audio, or informational data communication systems to administer two way medical advice, and remote control capability. Neither do existing life rafts incorporate a means to monitor the vital physical signs of the occupants.

There is a continuing unaddressed need for a life raft survival package to be used in search and rescue applications that can be deployed by air, land or sea to marine victims with means to specifically detect, target, manipulate, monitor, and communicate with the victims and the life raft survival package. The life raft survival package must have a degree of autonomy in all weather and be able to operate in zero visibility conditions. Once the victims are rescued, such a life raft survival package must provide for the continued survival of the victims by providing heat if necessary, drinkable water, food and other provisions, real-time two-way communication and remote control capability.

BRIEF DESCRIPTION OF THE DRAWINGS

FIG. 34 is a perspective view of the AMV apparatus depicting the effective vertical range and coverage of the peripheral fire suppressant and cooling spray system.

SUMMARY OF THE INVENTION

Figure 1:
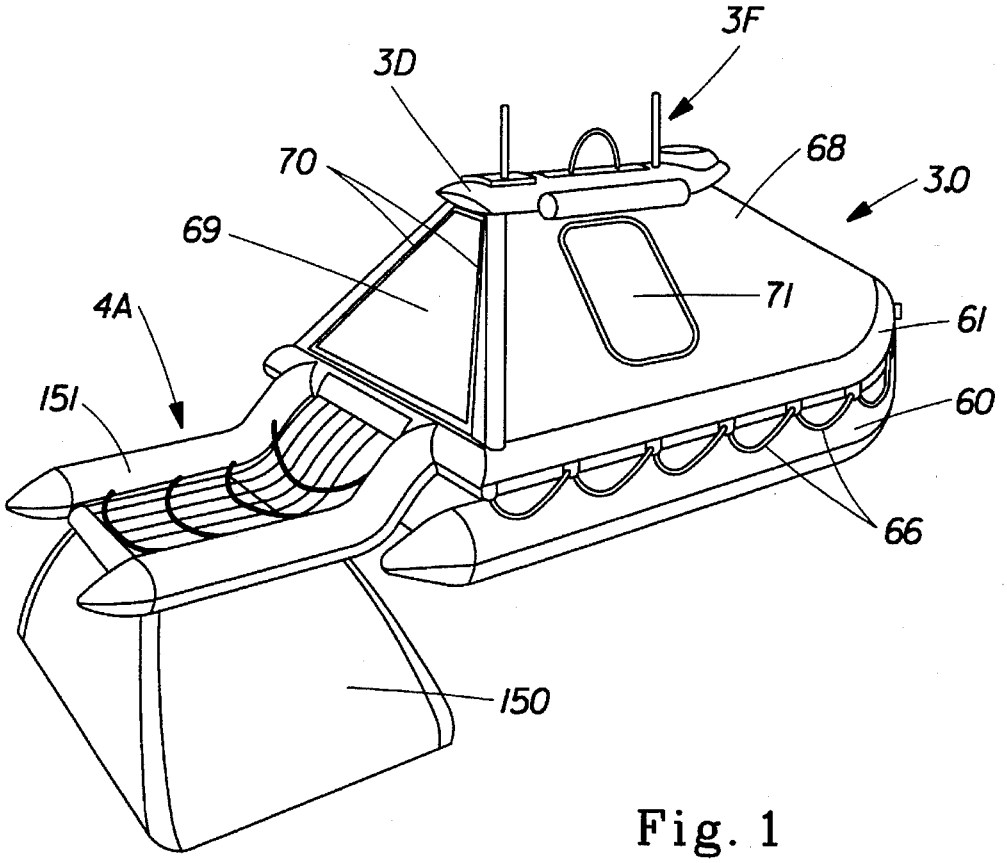
FIG. 1 is a rear perspective view of an inflated autonomous marine vehicle (AMV) apparatus in accordance with the present invention.

The foregoing problems with existing technology used in search and rescue operations have been overcome with the present invention. The system of this invention provides for a laser, radar, thermal or GPS guided autonomous or semi autonomous, self-propelled autonomous marine vehicle (AMV) apparatus to detect, recover, and provide life support to a person or persons in peril on the surface of an aqueous marine environment. The AMV apparatus comprises a rigid hull assembly, an inflatable hull and weather hood assembly or rigid shell weather hood assembly, power and propulsion means, telemetry control means, an electrical system, various auxiliary systems, and maintenance supplies.

The AMV apparatus comprises a generally boat-shaped rigid hull with interior chambers providing for a protective housing for the propulsion, control, and life support means. Folding hull wings provide for compact storage while allowing for increased deck space and floatation stability when deployed. The rigid hull and folding hull wings are comprised of fire retardant or fireproof composite or metal materials with watertight access panels to interior chambers of the rigid hull.

The AMV apparatus includes an inflatable hull and weather hood assembly that inflates to form an interior cabin space. Access is gained by way of an access opening in the rear of the weather hood. Visibility is provided for by acrylic windows in the sides of the weather hood. The inflatable hull and weather hood assembly is comprised of non-flammable materials.

As an alternative to the inflatable hull and weather hood assembly the AMV apparatus may use a rigid weather hood made of rigid materials such as composite, aluminum or ferrous metals. The rigid weather hood offers more durable protection from harsh environmental elements and is suitable for land or sea deployment.

The AMV apparatus is powered by an engine and propulsion system that provides a power source to drive a hydraulic pump, electrical generator, or a mechanical drive assembly that in turn provides hydraulic, electrical or mechanically transferred power for thruster propulsion and the generation of electrical power. The engine and propulsion system may be diesel-powered or other type (turbine, chemical, fuel cell, batteries).

A telemetry control station and interface allows the AMV apparatus to transmit and receive radio and satellite relayed voice, video, navigational, physiological life signs, mission commands, sensor, and other data between the SAR response center or platform, aircraft, ship, or oil rig, and the AMV apparatus. The AMV apparatus incorporates a hard-shell antenna housing with communications means disposed within it, such as antenna for various communications methods.

The AMV apparatus further incorporates a peripheral coolant spray system means recessed into the inflatable hull and weather hood assembly and further incorporating a rapid inflation means; a self placing vertical aluminum support strut means to provide rigid support to the hardshell antenna housing and auto-inflation self righting means mounted on top of the inflatable hull and weather hood assembly; and a helicopter lifting attachment hook fastened to the hard-shell antenna housing means mounted on top of the inflatable hull and weather hood assembly and connected to the self placing structural support strut means attached to the rigid hull means.

The AMV apparatus has an electrical system to generate, store, and distribute electricity to life support means, telemetry means, communications means, engine and propulsion system means, vehicle auxiliary systems means, sensor systems means, and on board mission control computer means.

The AMV apparatus has a control, navigation, and collision avoidance system to provide input to, and interface with, the on board mission control computer and software using satellite such as GPS, STARSYS, ARGOS, IRIDIUM, or INMARSAT, radio, or acoustic, proximity warning, location or navigational data collection and a vehicle control means to interface with a vehicle operator control station means and provide collision avoidance, and directional control to hydraulic, electrical, or mechanical, thruster means, and mission response instructions to vehicle mounted personnel detection sensors means, life support means, vehicle auxiliary systems means, and communications system means.

The AMV apparatus has an auxiliary system comprising an air compressor means to provide air for the inflatable hull flotation component means, as well as a pneumatically actuated hydraulic and pneumatic lift. The auxiliary system further comprises a saltwater desalination means to provide drinking water, and a heater means to provide heat for life support means, a physiological vital signs monitoring means, and a bilge pump means to remove water from interior hull spaces and a pumping means to provide cooling water to the periphery fireproof spray system means.

Personnel recovery means is provided for on the AMV apparatus for lifting and otherwise assisting a physically impaired, hypothermic, exhausted, or injured person to exit the water and gain entrance to the AMV apparatus interior cabin space by a hydraulic and pneumatically actuated lift. The personnel recovery means is comprised of a robotic arm assembly capable of lifting weight in excess of 400 pounds comprised of a pair of mechanical hydraulically actuated cylinder arms that are hinged at the cylinder base to a shoulder assembly, and fastened to the AMV apparatus transom. The cylinder arms actuate an inflatable recovery chute that provides a rapidly inflated cushioned recovery chute mounted between the pair of mechanical hydraulically actuated cylinder arms to elevate persons suffering from restricted mobility above the horizontal plane of the AMV apparatus rigid hull and the surface of the water to permit the rescued individual to crawl or fall forward into the interior cabin space of the AMV apparatus through a self sealing flap opening located in the rear of the inflatable hull and weather hood assembly.

The AMV apparatus is aided in search and rescue by an aircraft, ship, oil rig, or shore based sensor detection and targeting system capable of detecting people floating on the surface of a body of water and determining their position coordinates relative to the Global Positioning System (GPS) and possessing a laser, radar or thermal guidance package capable of dynamically directing the AMV apparatus to a system operator defined, or sensor specified coordinate.

The present invention further provides means for deployment of the AMV apparatus, including means for launching from an aircraft, comprising: (1) an air deployment casing to provide an interior space for containing and providing an aerodynamic cylindrical shaped protective housing for the AMV apparatus while mounted externally on the wings or fuselage of an aircraft, or within the bomb bay or cargo bay of a deployment aircraft. The air deployment casing is constructed of composite, or metal materials that form a forward cylindrical casing with a rear cone assembly joined together around their circumference with a casing sealing and separation actuator means; (2) an active steering control and recovery parachute subassembly with preprogramming or real-time GPS guidance means and parachute steering control actuation means.

The present invention also provides for air deployment either by use of: (1) an aircraft externally mounted air deployment system utilizing a wing or fuselage mounted air deployment casing and being ejected from the aircraft while in flight by a BRU-11 or TER-7, for example from a Lockheed P-3 Orion; or by use of (2) an aircraft internally mounted air deployment system comprised of a disposable cradle to deploy the AMV apparatus and air deployment casing from the rear door of an aircraft such as a Lockheed C-130, Casa 212, Dehaviland Buffalo, or similar aircraft with rear egress capability. When deployed in this manner, the AMV apparatus is ejected from the aircraft while in flight using an extraction parachute assembly means with a recovery parachute assembly means and a water-actuated AMV apparatus upper hull inflation actuator means.

The present invention further provides for sub-surface submarine based deployment means comprising a pressure rated subsurface deployment casing to provide a protective housing for the AMV apparatus while mounted externally on the hull, or within the torpedo tubes, diver lockout, or other submarine pressure hull orifice ejection system means.

The present invention further provides for a ship, oil rig, lighthouse, dock, or other shore based deployment means comprising: (1) a sea or land deployment casing to provide an interior space for containing and providing a cylindrical shaped protective housing for the AMV apparatus while mounted on a ship, oil rig, lighthouse, dock or other sea or shore based facility; and (2) a shore, rig, or ship mounted launch system utilizing an ejection rail or tube affixed to a concrete foundation, or ship or oil rig deck, the launch system being actuated remotely from the ship, oil rig, lighthouse, dock or other facility rail or tube through satellite, radio, or hard wired control link telemetry means.

The present invention further provides for a series of waterproof vehicle and life support hull compartments containing food, water, first aid equipment, and various survival provisions means, and AMV apparatus maintenance tools, instructions, and basic repair materials.

DETAILED DESCRIPTION OF THE INVENTION

The invention is now described in terms of the FIGURES to more carefully delineate in more detail the scope, materials, conditions, and methods of the present invention.

FIGS. 1 through 7 show the overall external configuration of the autonomous marine vehicle (AMV) apparatus 3.0, in accordance with the present invention. The preferred embodiment of the AMV apparatus 3.0, is an autonomous or semi autonomous land, sea or air deployed rescue vehicle hereinafter denoted as the AMV apparatus 3.0. By "autonomous" vehicle is meant one which utilizes a real time artificially intelligent expert system that enables it to undertake mission programming, both predefined and dynamic in conjunction with self preservation, self maintenance, and one which is able to respond to opportunities or threats encountered in the course of undertaking its mission programming without human assistance. The autonomous vehicle relative to this application also embodies a preemptive scheduler with error code programming. An example of such an expert system would be those designed and utilized by International Submarine Engineering on the ARCS DOLPHIN® and THESIUS® autonomous underwater vehicles. By "semi-autonomous" vehicle is one that has full or partial autonomous capability with an ability to be manipulated or directly controlled by a human operator.

The AMV apparatus 3.0 includes a rigid hull assembly 3A, an inflatable hull and weather hood assembly 3B, or a rigid shell weather hood assembly 3C, a hardshell antenna housing 3D, a power and propulsion system 3E, a control, navigation and collision avoidance system 3F, an electrical system 3G, various auxiliary systems 3H, survival gear and provisioning supplies, and AMV apparatus 3.0 apparatus maintenance supplies.

Figure 15:
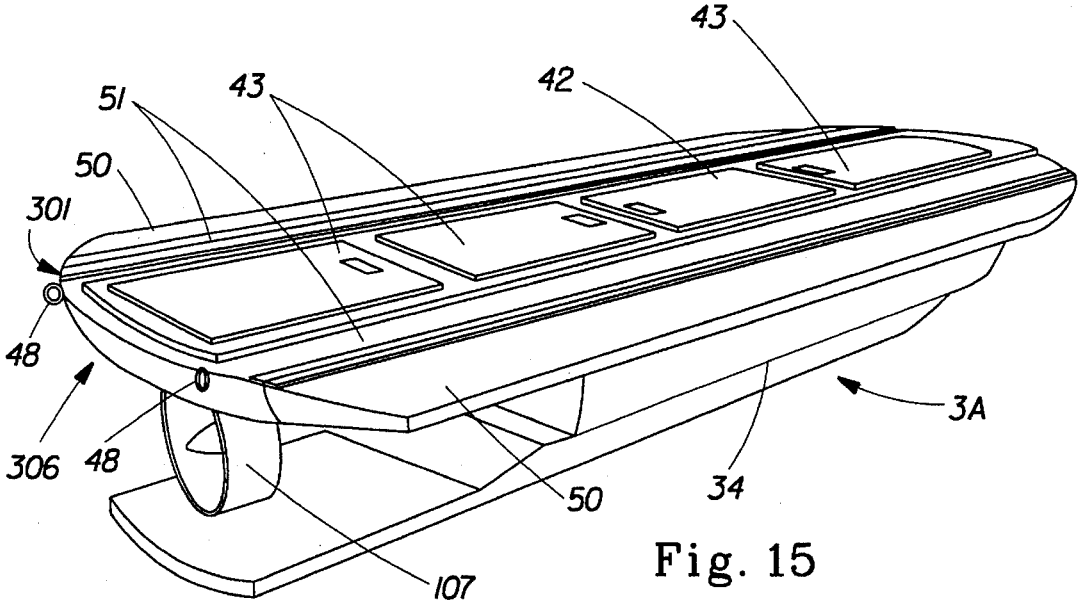
FIG. 15 is a perspective view from the stern of the rigid hull assembly with hull wings extended, and without inflatable components depicting rigid hull enclosure, configured in accordance with the present invention.
Figure 16:
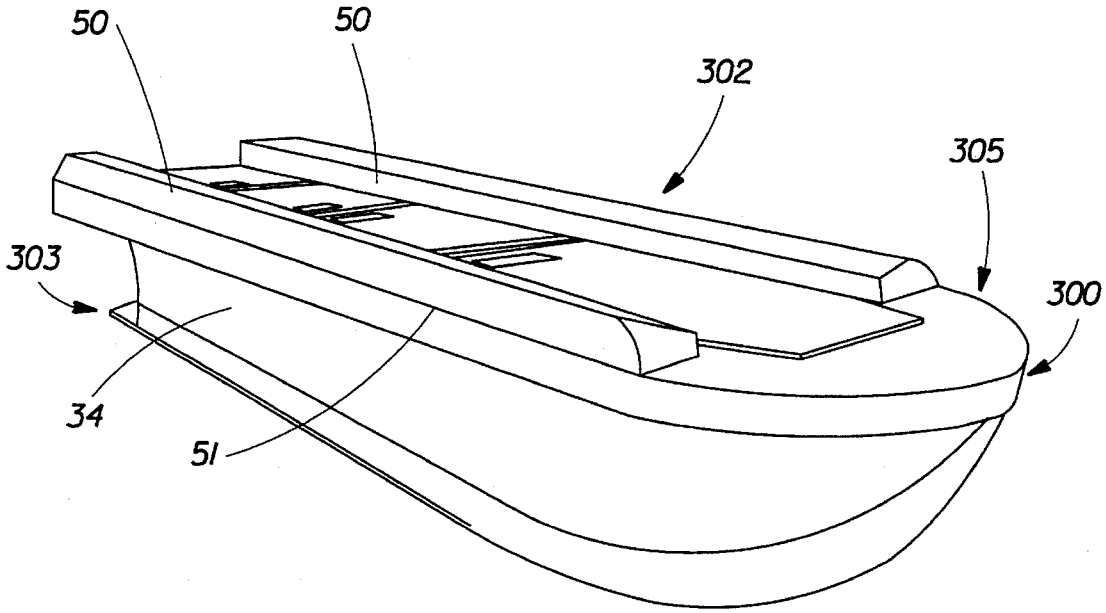
FIG. 16 is a perspective view from the bow of the rigid hull assembly with hull wings folded, and without inflatable components depicting rigid hull enclosure, configured in accordance with the present invention.
Figure 17:
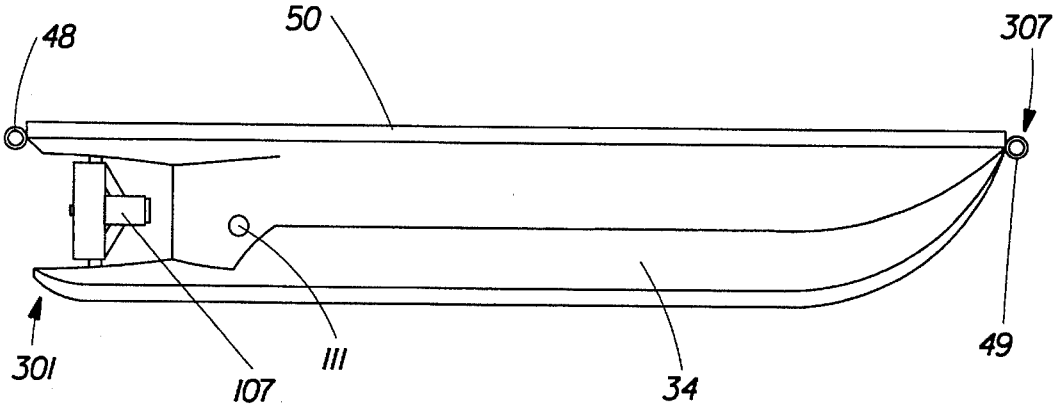
FIG. 17 is a profile view of the rigid hull assembly with folding rigid hull wings extended, and without inflatable components depicting rigid hull enclosure, configured in accordance with the present invention.
Figure 18:
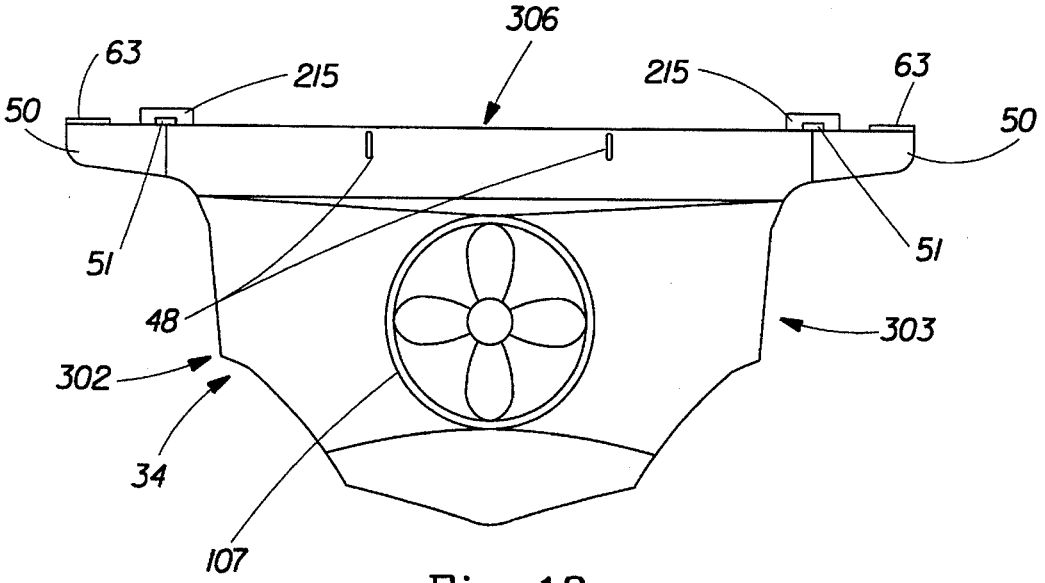
FIG. 18 is an elevation view of the stern, depicting the rigid hull assembly with folding rigid hull wings extended, and without inflatable components, configured in accordance with the present invention.
Figure 18A:
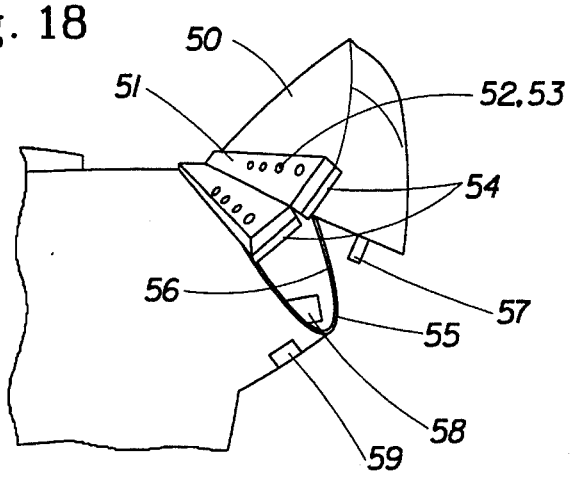
FIG. 18A is a detail view of the folding rigid hull wings showing hinge apparatus and locking apparatus.
Figure 19:
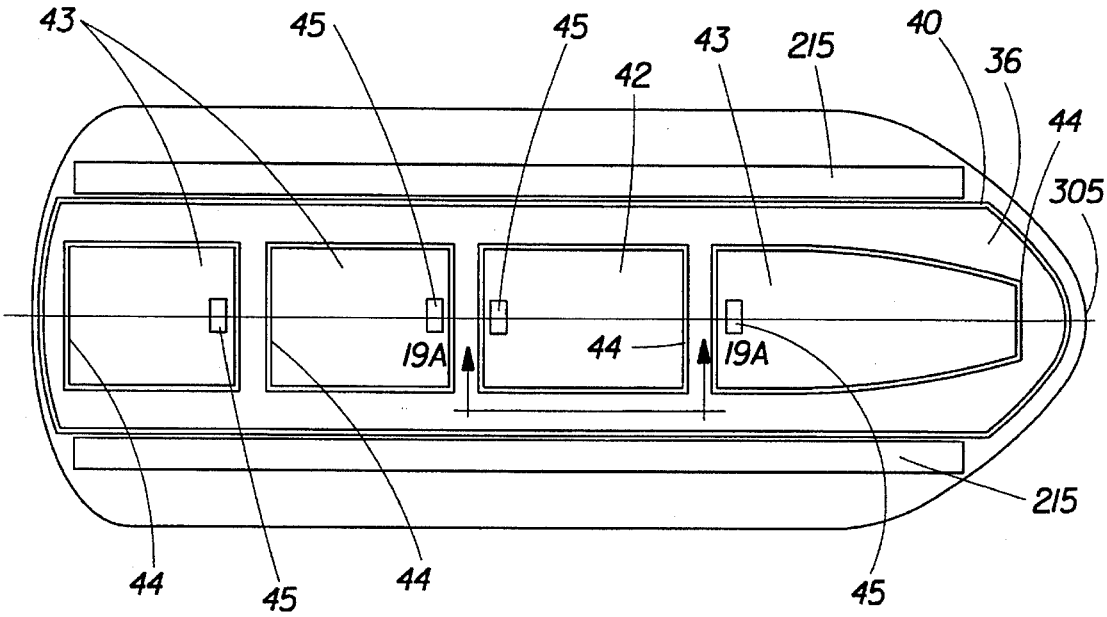
FIG. 19 is a detail plan view of the deck portion of the AMV apparatus rigid hull assembly depicting the recessed storage and access hatches.
Figure 19A:
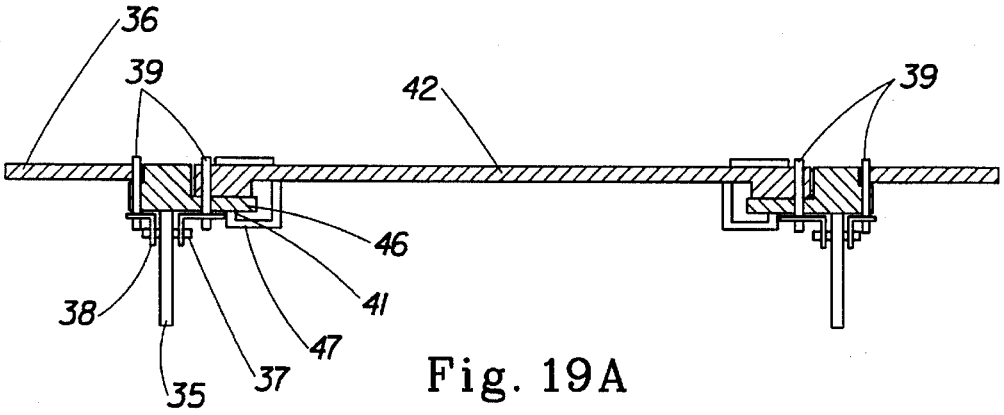
Figure 20:
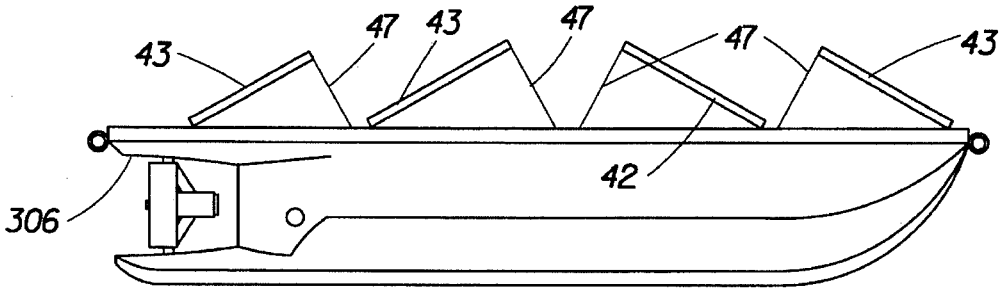
FIG. 20 is an elevation view in section of the rigid hull assembly depicting overall recessed deck, hinges, and hatch fastening configuration of the AMV apparatus.
Figure 21:
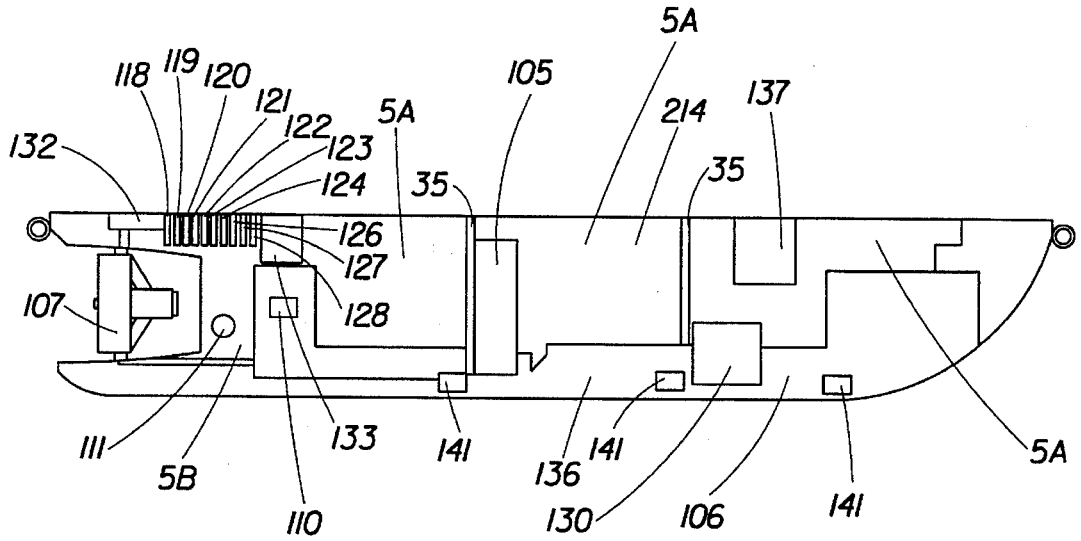
FIG. 21 is a profile view in section of the rigid hull assembly depicting overall recessed deck, storage compartments, water tanks, fuel tanks, and hatch fastening configuration with bulkhead fastening detail drawing of the AMV apparatus.

FIGS. 15 through 21 show the details of the rigid hull assembly 3A. The rigid hull assembly 3A is includes a rigid hull 34 that forms the outer surface that can best be described as boat-shaped. The rigid hull 34 has a bow 300 shown in FIG. 16, and a stern 301, shown in FIGS. 15 and 17. The rigid hull 34 also has two sides, generally referred to as port 302 and starboard 303 or left and right, respectively, as shown in FIGS. 16 and 18. The rigid hull 34 also has an upper periphery 305 around the top of the sides 302, 303, from the bow 300 to the stern 301. While it is contemplated for the preferred embodiment of the rigid hull 34 to utilize a Spectra® (TM of Allied Signal) fiber, fiberglass, Kevlar® (TM of DuPont) aramid, and graphite composite material, it is apparent that other materials like aluminum, or ferrous metals could be substituted with varying degrees of performance and cost effectiveness. The materials contemplated are generally fire resistant or fireproof such that the AMV apparatus is capable of sustaining operations in extreme heat or flame for suspended periods of time. The rigid hull 34 is manufactured by means known and common in the art. The rigid hull 34 provides interior chambers 304 as shown in FIGS. 21 and 22, for various internally mounted power and propulsion systems means 3E, control, navigation and collision avoidance system means 3F, electrical system means 3G, and various auxiliary systems means 3H.

Figure 22:
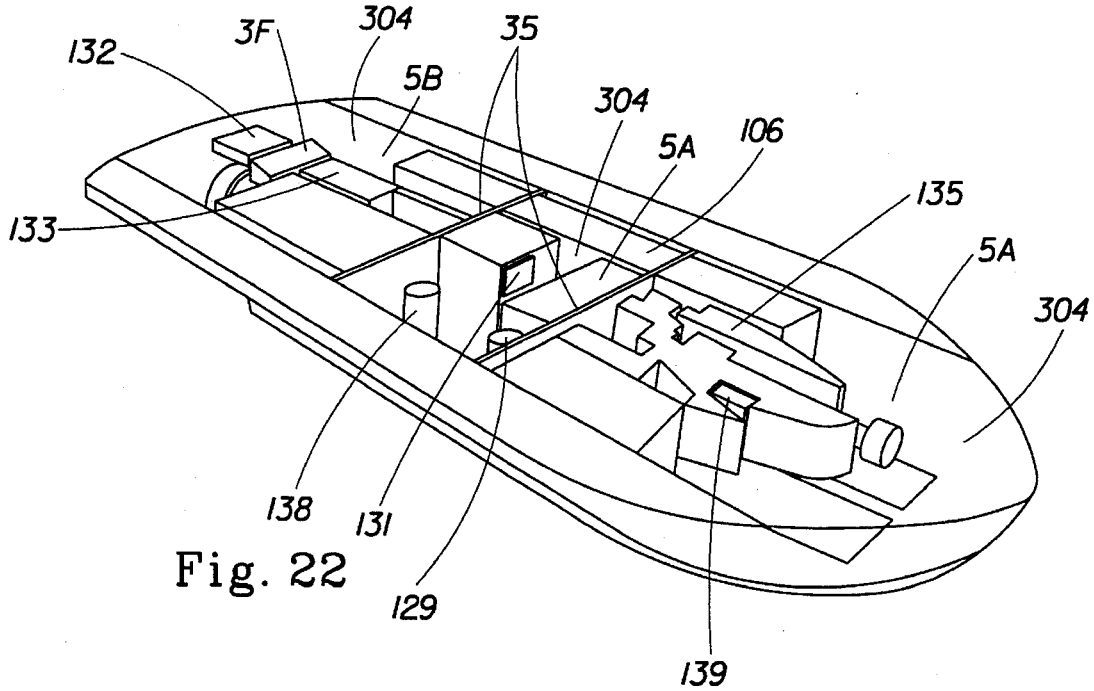
FIG. 22 is a translucent perspective view of the AMV apparatus rigid hull, and internal component configuration in accordance with the present invention.

FIGS. 21 and 22 show the rigid hull 34 in the preferred embodiment divided into three interior chambers 304 by internal bulkheads 35, located near the center of the rigid hull 34. The interior chambers 304 are enclosed above by a recessed deck panel 36 with access hatches 43, shown in FIG. 19. As shown in FIG. 19 section A—A, the internal bulkheads 35 are fastened and sealed to the recessed deck panel 36, through four bolt, lock washer, and locking nut assemblies means 37, drilled through the upper portion of the internal bulkheads 35 and fastened to angle brackets 38, laminated on the bottom side of the recessed deck panel 36 and made watertight between interior chambers with a waterproof peripheral deck panel waterproof sealing ring means 40.

FIG. 19 shows the rigid hull 34 is sealed along its upper periphery 305 by sealing means 40 to the recessed deck panel 36 held in place by a series of deck bolts, steel washers, rubber washers, and lock nut assemblies means 39, as shown in FIG. 19 section A—A, which are drilled and fastened around the periphery of the recessed deck panel 36 with a waterproof sealing ring means attached to the rigid hull 34 with an adhesive bonding agent means, to effect a watertight seal when sandwiched between the rigid hull 34 and the deck panel 36. The deck panel 36 is further divided into recessed sections incorporating an engine access hatch means 42, and several life support/provision access hatches means 43, each incorporating an access hatch hinge mechanism means 44, a access hatch flush locking mechanism means 45, a peripheral access hatch rubber sealing ring means 46 located around the recessed periphery of each access hatch means 42 and 43 opening, and a collapsible access hatch rubber water protection hood means 47, which prevents water from entering the recessed access panel cavities over the deck when the hatch means 42 and 43, are opened as shown in FIG. 20. Sealing means is accomplished by methods known in the art such as by use of neoprene boot means adhesively attached to mating elements. Adhesive bonding means is accomplished by any of common and known adhesive bonding agents suitable for marine use.

FIGS. 17 and 18 show the rigid hull 34 also serves as a fastening platform for two stern towing eyelets means 48, mounted on a transom means 306, and a bow towing eyelet means 49, mounted on the forward hull chine means 307.

FIGS. 15, 16, 17, and 18 show a pair of floatation foam filled folding rigid hull wings 50 which generally run the length of the AMV apparatus 3.0, one on the left side 302, and one on the right side 303, and fold from an inward position as shown in FIG. 16 to an outward position as shown in FIG. 15. When folded out, the folding rigid hull wings 50 provide a wider floor area, but are folded inward to accommodate compact enclosure within an aircraft mountable air deployment casing (ADC) assembly 6A, shown in FIGS. 37, 40, 42, and 43. The preferred embodiment contemplates making the folding rigid hull wings 50 from the same materials as are used for the rigid hull 34. The folding rigid hull wings 50 are floatation foam filled to provide additional floatation means. When the folding rigid hull wings 50 are folded inward it allows the AMV apparatus 3.0 to be stored for deployment in existing-technology air deployment casings. When folded outward the folding rigid hull wings 50 provide additional floatation as well as dramatically increasing the stability of the AMV apparatus 3.0 in rough seas.

As contemplated by the present invention, the folding rigid hull wings 50 are fastened to the rigid hull 34 by a pair of stainless steel piano hinge means 51 drilled with countersunk holes on three inch centers throughout the length of the piano hinges means 51 and fastened with PEM bolts means 52 inserted into embedded PEM Nuts means 53 which are crush mounted through stainless steel backing plates means 54, laminated into the underside of the rigid hull wing seats means 55, as shown in FIG. 18. The stainless piano hinge means 51 incorporate piano hinge seal means 215 preferably made of Hypalon rubberized fabric covers laminated to the rigid hull wing 34 and the recessed deck panel 36 and to the fireproof lower inflatable hull tube 60 to provide a watertight seal. Further, the folding rigid hull wings 50 are locked down into the open position as shown in FIG. 15 when the AMV apparatus 3.0 inflatable hull and weatherhood assembly 3B is inflated forcing the folding rigid hull wings 50 out and down onto the rigid hull wing seat plastic crush pads 56, with sufficient force as to drive four hull wing stainless steel locking bolts means 57, located at evenly spaced intervals along the length of each folding rigid hull wings 50 into folding rigid hull wing seat female locking mechanisms means 58 which can be released through activation of a series of hull wing lock release mechanisms means 59, located on the sides of the rigid hull means 34 under the rigid hull wing seats means 55 which enable the folding rigid hull wings 50 to be folded inward for packaging and inspection of the rigid hull wing seat means 50 and hull wing seat female locking mechanisms means 58.

The preferred embodiment of the present invention incorporates an inflatable hull and weather hood assembly 3B attached to the rigid hull 34 of the rigid hull assembly 3A. FIGS. 1, 2, and 4 through 7 show the overall configuration of the AMV apparatus 3.0 with the inflatable hull and weather hood assembly 3B attached to the rigid hull 34 in accordance with the present invention. The inflatable hull and weather hood assembly 3B inflates to form an interior cabin space 311, shown with occupant in the interior cabin space in FIG. 35. The inflatable hull and weather hood assembly 3B includes a generally fire resistant or fireproof lower inflatable hull tube 60, mounted around the upper periphery 305 of the rigid hull 34, and folding rigid hull wings 50, being attached to same through a lower and upper inflatable hull tube adhesion strip means, attached to the folding rigid hull wings 50, and rigid hull tube lamination lip means 63, shown in FIG. 18, which forms part of the rigid hull 34, and is further fastened to the fireproof upper inflatable hull tube 61, mounted around the topside circumference of the fireproof lower inflatable hull means 60, being attached to same through the adhesion strip means laminated between and on both sides of the fireproof lower inflatable hull tube 60 and fireproof upper inflatable hull tube 61. By fireproof is meant non-combustible, generally flame resistant, providing an insulating function against extreme heat. Examples of such materials are Nomex® (TM of DuPont) and asbestos-based materials. The preferred embodiment contemplates a laminate of Hypalon or butyl or 1100 DTX fabric Neoprene/Hypalon as structural elements and fireproof materials for insulating elements. The invention further provides for the fireproof upper inflatable hull tube 61 to be incorporate an inflatable hull and weather hood support tube strut 64 capable of supporting the inflatable hull and weather hood assembly 3B and hardshell antenna housing assembly 3D, and further incorporates interconnected inflation valves means, and grab ropes 66.

In the preferred embodiment the inflatable hull and weather hood assembly 3B incorporates a fire resistant or fireproof weather hood 68 that forms the interior cabin space 311 comprised of fireproof fabric such as Nomex® and asbestos-based materials. The weather hood 68 forms generally vertical sidewalls, with a weather hood access opening 69 in the stern side of the weather hood 68 which is sealed with weather hood access zipper and Velcro sealing flap means 70 fabricated of similar materials to the inflatable hull and weather hood assembly 3B. The weather hood 68 also incorporates a fireproof flap covered weather hood acrylic window means 71, and weather hood acrylic window zipper and Velcro sealing flap means. The weather hood 68 is constructed by conventional methods known in the art.

Figure 28:
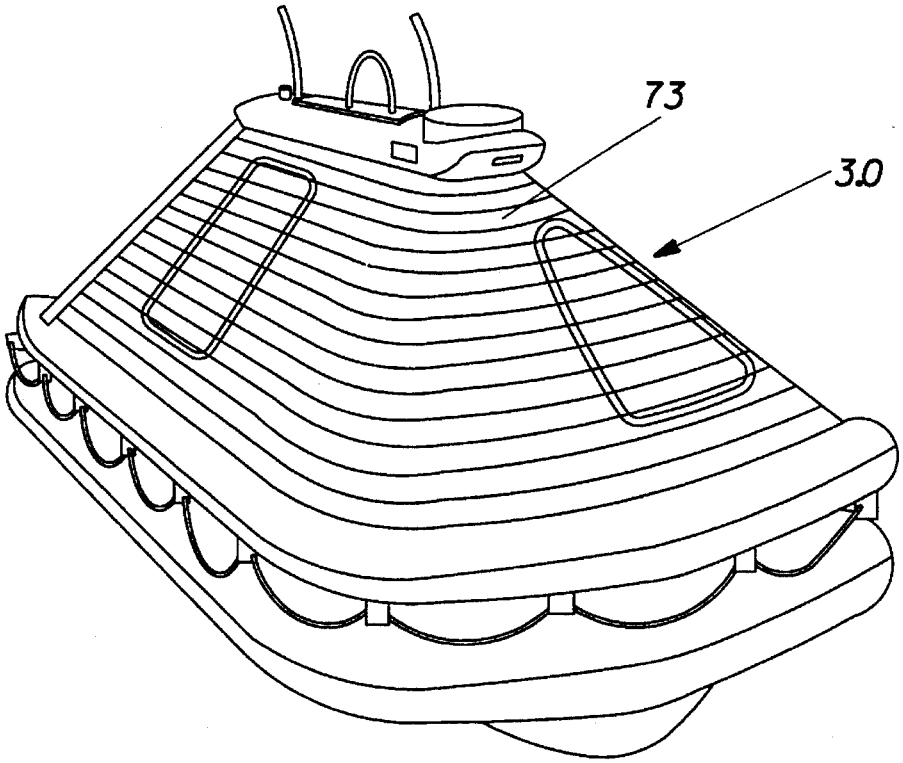
FIG. 28 is a perspective translucent view of the AMV apparatus depicting the removable interior weather hood polar insulation liner.
Figure 29:
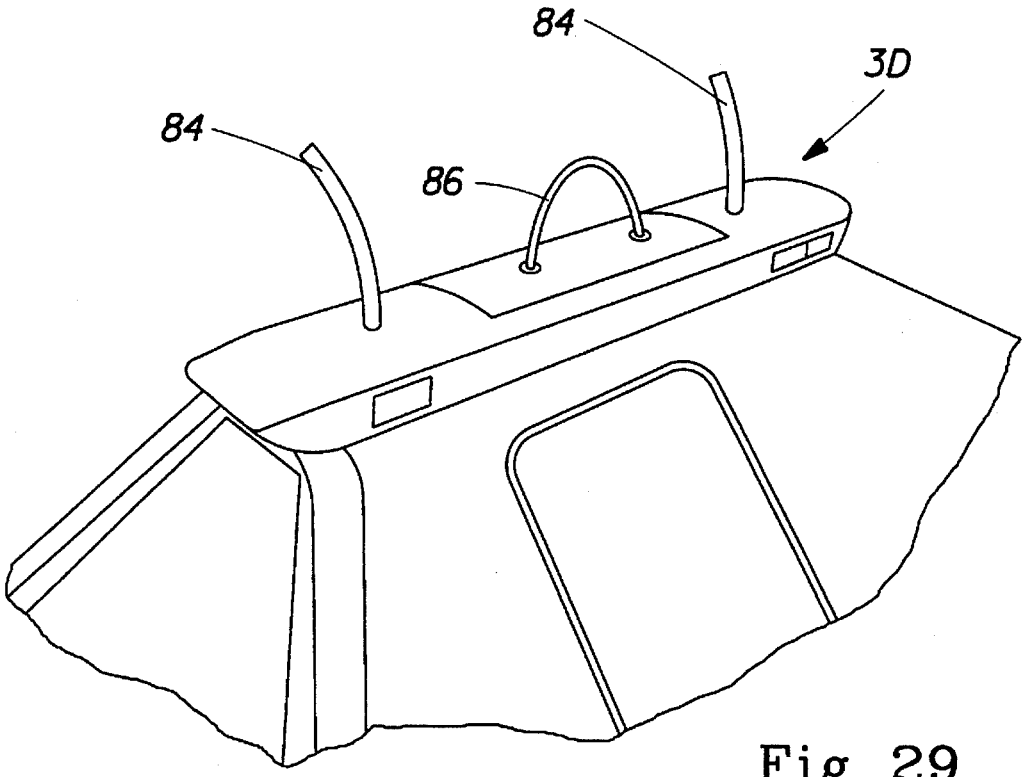
FIG. 29 is a perspective view of the AMV apparatus depicting the hardshell antenna housing with photovoltaic cell array, antenna, control, telemetry, audio, lighting, sensor, auto self righting inflation mechanism, and lifting device.

For use in extremely cold climates, the present invention contemplates that the inflatable hull and weather hood assembly 3B is further equipped with an inflatable polar insulation liner 73, shown in FIG. 28, fastened to the inside of the inflatable hull and weather hood assembly 3B with a series of polar insulation liner zipper and Velcro fastening strips means. In FIG. 28 the weather hood 68 is not shown so as to better show the polar insulation liner 73. The inflatable polar insulation liner 73 is formed of a series of tubes through which warm air is circulated, and it is contemplated that the tubes are formed in such a manner so as to facilitate visibility from the AMV apparatus 3.0 though access openings and window means.

It is further contemplated that the fireproof lower inflatable hull tube 60, the fireproof upper inflatable hull tube 61, and the inflatable hull and weather hood assembly 3B, are further equipped with fitted fireproof hull and weather hood cover flaps means which may be simply rolled onto the inflatable hull and weather hood assembly 3B, and once deployed, are held in place by fireproof hull cover zipper and Velcro sealing flaps means.

Figure 3:
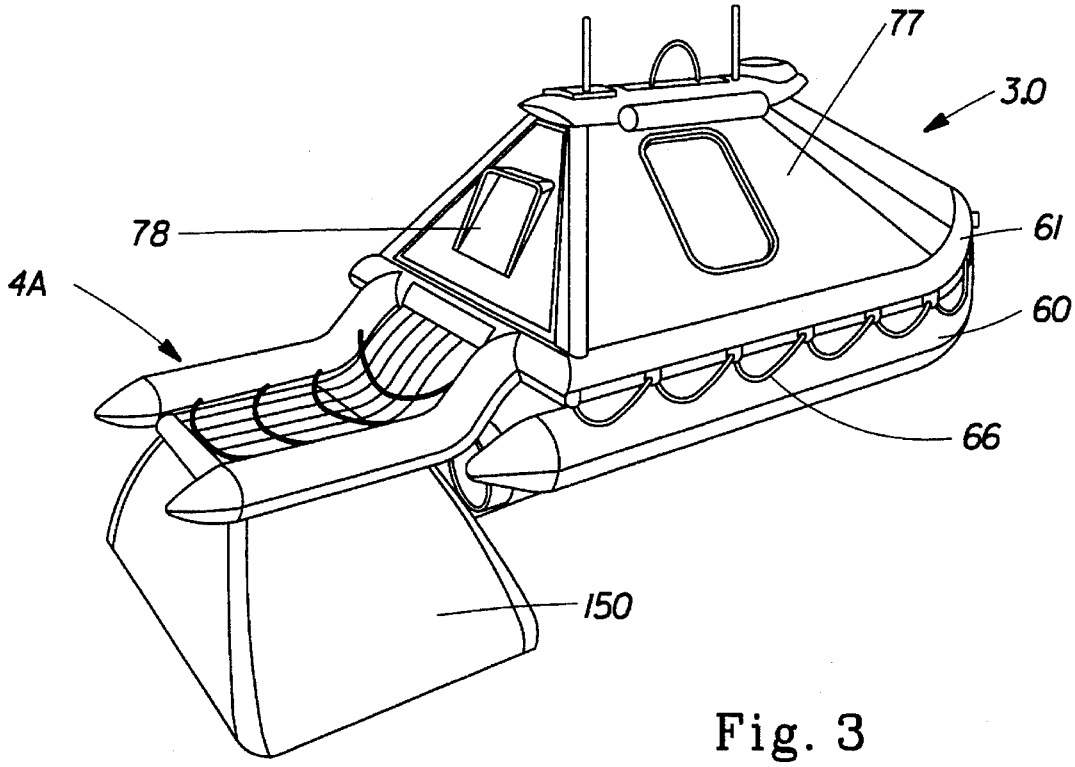
FIG. 3 is a rear perspective view exhibiting overall AMV apparatus configuration with rigid shell weather hood assembly in place and hydraulic and pneumatic lift extended in the horizontal plane.

As an alternative to the inflatable hull and weather assembly 3B, one embodiment of the present invention contemplates a rigid shell weather hood assembly 3C as shown in FIG. 3. The rigid weather hood assembly 3C offers more durable protection from harsh environmental elements. The rigid weather hood assembly 3C is comprised of a composite, aluminum or ferrous metal rigid weather hood structure 77 incorporating rigid weather hood access hatches 78 made of composite, aluminum or ferrous metals and mounted onto the rigid weather hood assembly structure 77 with stainless steel hatch hinges means, and fastened closed or opened by actuating or releasing a series of rigid weather hood access hatch lock latches means. The rigid weather hood is constructed by conventional means known in the art and affixed to the inflatable hull by adhesive means known in the art and suitable for marine applications. This embodiment cannot be stored in air deployment cases and is suitable for land or sea deployment where storage space is available.

Figure 30:
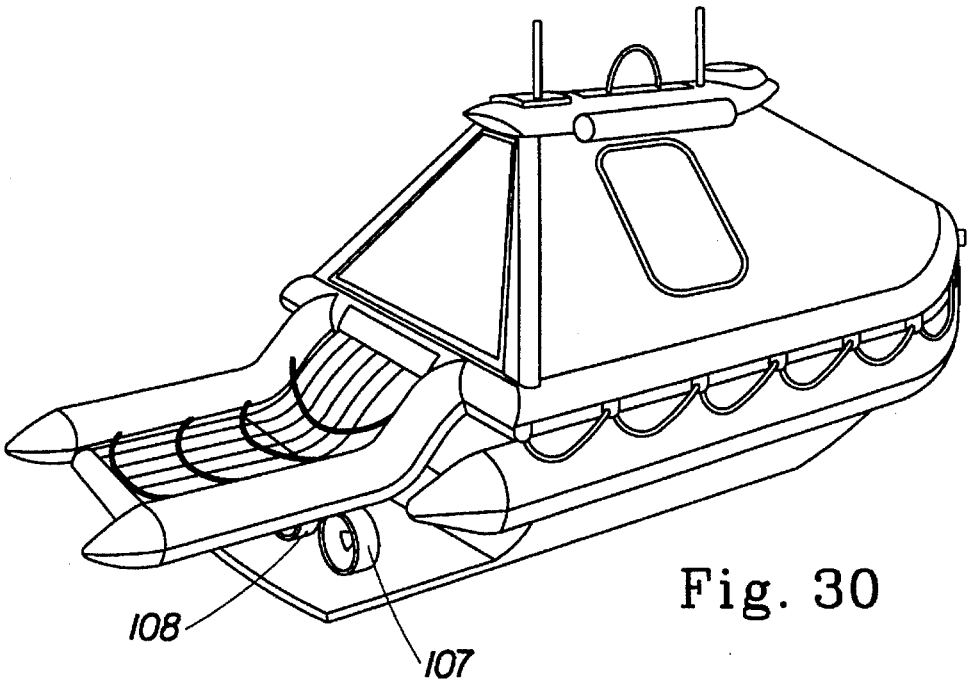
FIG. 30 is a rear perspective view of the AMV apparatus depicting a dual thruster configuration.

The preferred embodiment of the AMV apparatus incorporates a power and propulsion system 3E, attached to, and enclosed within the rigid hull assembly 3A as shown in FIGS. 19 through 22. FIGS. 21 and 22 depict the overall configuration of the rigid hull assembly 3A, as it pertains to the mounting and enclosure of the power and propulsion system comprised of a power pack 105, which in the preferred embodiment is diesel powered, such as Yanmar L-A series diesel engine, in which case the fuel tanks 106, hold diesel fuel. It is apparent that other sources of power such as gasoline or electricity may be used. In addition, solid polymer fuel cells utilizing cryogenic oxygen and hydrogen as fuel may also be used instead of a diesel powered internal combustion engine. The power pack 105, provides hydraulic power to the various devices of the AMV apparatus 3.0. The power pack 105 also provides power for propulsion by powering the thruster assembly 107 which is disposed horizontally into its operative position as shown in FIG. 21. It can be rotated about the vertical axis to effect steering capability. Although the preferred embodiment of the present invention uses one thruster to effect propulsion, it is apparent that a second thruster 108 could also be utilized in a tandem configuration as shown in FIG. 30. The thrusters contemplated are comparable to those manufactured by International Submarine Engineering.

Figure 23:
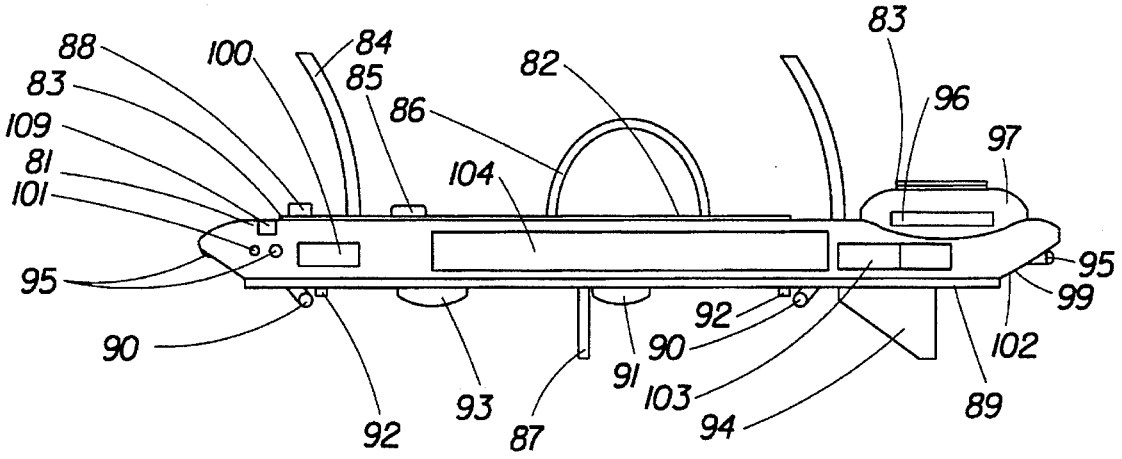
FIG. 23 is a detail elevation and plan view of the hardshell antenna housing assembly exhibiting the radar, lighting, video, antennae, cleaning spray nozzles, and air intake aperture.
Figure 24:
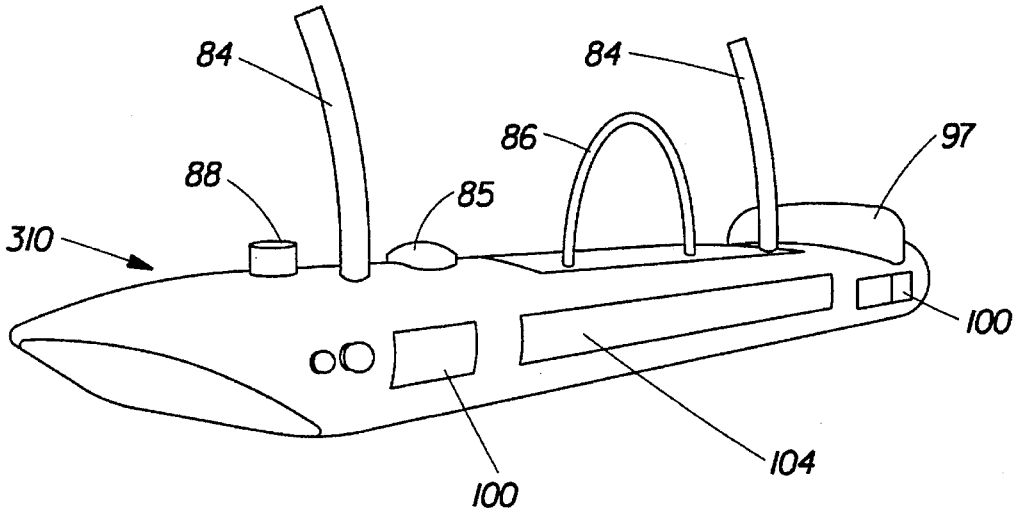
FIG. 24 is a perspective view of the hardshell antenna housing assembly exhibiting the radar, lighting, video, antennae, and cleaning spray nozzles.
Figure 25:
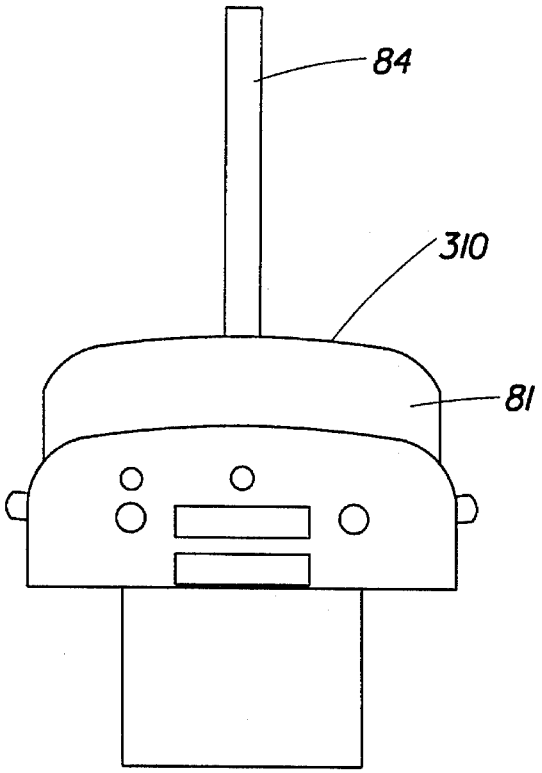
FIG. 25 is a detail frontal elevation view of the hardshell antenna housing assembly exhibiting the radar, lighting, video, antennae, cleaning spray nozzles, and AMV apparatus sensor appendages.
Figure 26:
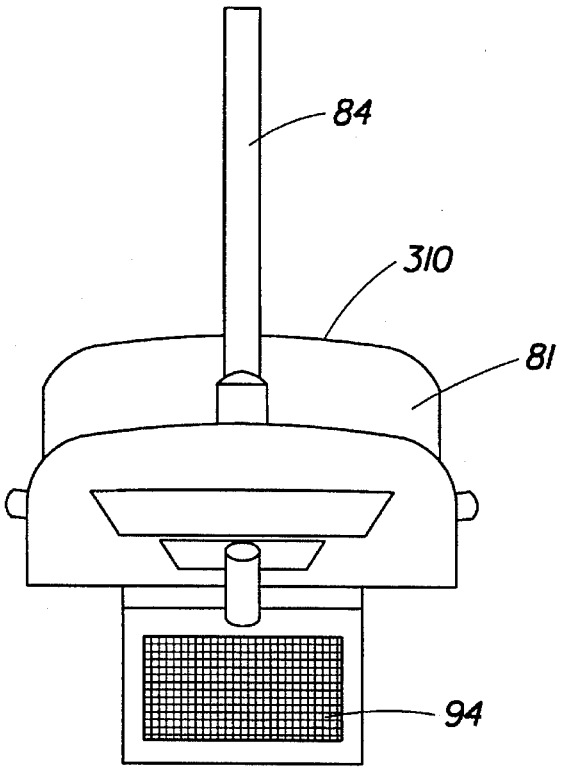
FIG. 26 is a detail rear elevation view of the hardshell antenna housing assembly exhibiting the radar, lighting, video, antennae, and cleaning spray nozzles.
Figure 31:
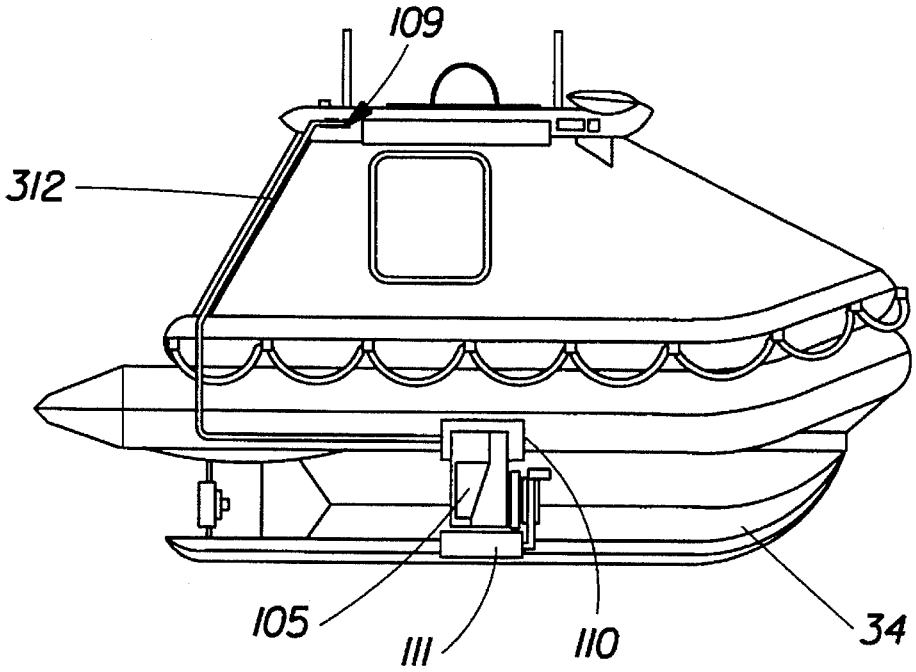

The preferred embodiment of the AMV apparatus 3.0 contemplates an engine air intake port means 109, shown in FIG. 31 and 23, for the power pack means 105, located within the rigid antenna housing 81 and connected by tubing 312 to a centrifugal air and water separator means 110, incorporated within the rigid hull assembly 34. The centrifugal air and water separator means is typical of that manufactured by International Submarine Engineering and used by the Dolphin autonomous underwater vehicle (AUV). In the preferred embodiment of the present invention a one-way exhaust valve means 111 is vented below water level to minimize contamination of the AMV apparatus 3.0 interior cabin space air. The one-way exhaust valve means is also typical of that manufactured by International Submarine Engineering and used by the Dolphin AUV.

Other embodiments of the power pack means 105 are contemplated, such as vehicle operational indicators that can be monitored and controlled by the AMV apparatus 3.0 occupants through use of a power pack, fuel, and oil gauge remote control panel means. Where an internal combustion or other type of power pack means 105 uses some form of reciprocating starter mechanism, either an electric starter, or a hand crank pull start device can be employed to effect ignition. Power pack means 105 cooling can be accomplished using either an air cooled fan system, which draws air from the engine air intake port means 109, or can incorporate a water cooled keel mechanism. The preferred embodiment of the present invention also incorporates an automated fire extinguisher system of a halon gas or dry chemical type within the engine compartment.

Figure 33:
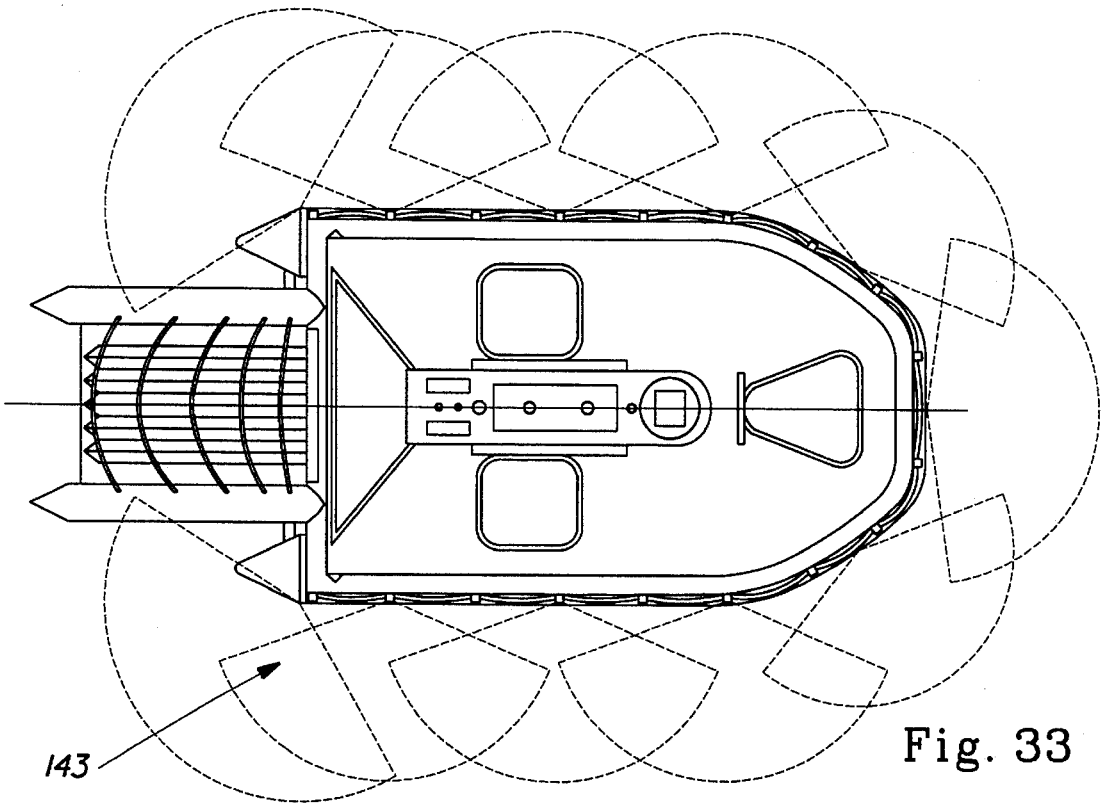
FIG. 33 is a plan view of the AMV apparatus depicting the effective horizontal range and coverage of the peripheral fire suppressant and cooling spray system.
Figure 34:
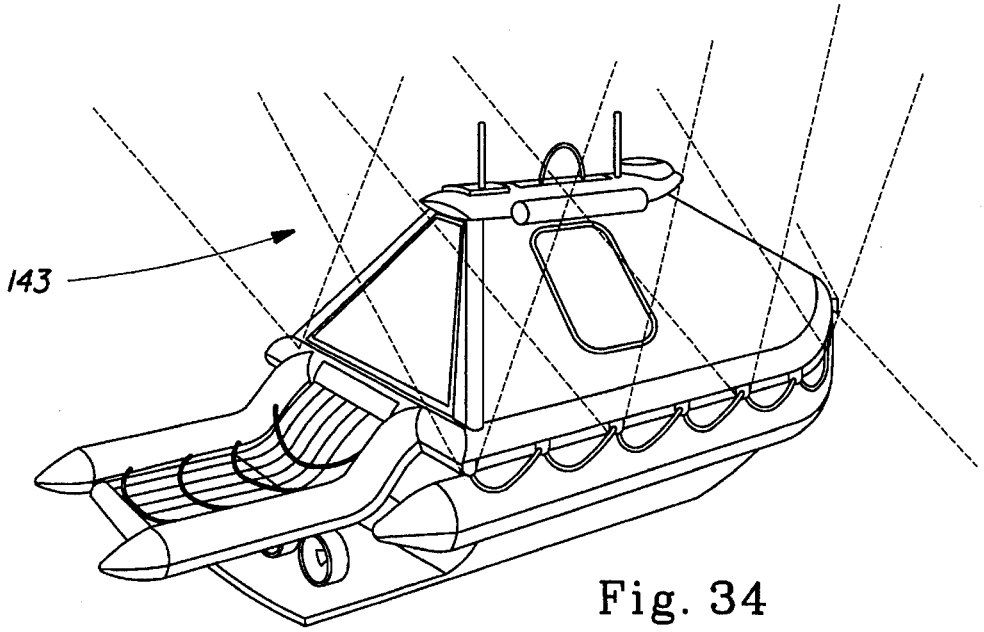
FIG. 34 is a translucent profile view of the AMV apparatus depicting the engine and compressor fresh air intake and water separation device.

The preferred embodiment of the AMV apparatus 3.0 contemplates a fire protection periphery spray system 143 shown in FIGS. 33 and 34. The fire protection periphery system 143 is comprised of pressurized water provided by the water pump means 141 directed from a plurality of outlets so as to fan out around the AMV apparatus 3.0 allowing it to traverse burning oil patches or other extreme heat conditions.

The preferred embodiment of the present invention also incorporates a hardshell antenna housing assembly 3D, mounted at the top of the inflatable hull and weather hood assembly 3B, or rigid shell weather hood assembly 3C. FIGS. 1,2 and 4 through 7 show the overall configuration of the AMV apparatus 3.0 with the hardshell antenna housing assembly 3D mounted at the top of the inflatable hull and weather hood assembly. FIG. 3 shows the overall configuration of the AMV apparatus 3.0, with the hardshell antenna housing assembly 3D mounted on top of the rigid shell weather hood assembly 3C. FIGS. 23 through 26 and 29 show detail views of the hardshell antenna housing assembly 3D and will be used to further delineate the preferred embodiment of the invention.

The hardshell antenna housing assembly 3D incorporates a rigid antenna housing 81 which includes a topside surface 310 which serves as a mounting surface for a photovoltaic cell array means 82. The photovoltaic cell array means 82 is used for battery recharging as well as to power a two-way integrated flat patch array satellite data telemetry and communications antenna means 83, a two-way radio frequency data (RF) and communications telemetry antenna means 84, and a global positioning satellite (GPS) antenna means 85 for AMV apparatus 3.0 navigation and positioning, such as the Magellan series GPS antenna system. The preferred embodiment of the photovoltaic cell array means 82 contemplates using a UNI-SOLAR® (TM of United Solar Systems Corp.) MBC-131 solar panel set up and operated as known in the art.

FIG. 23 shows the antenna housing bottom mounting board means 89, fastened to the bottom of the rigid antenna housing 81 which provides a removable mounting surface for several communication and lighting devices including two interior video cameras means 90, directed at opposite ends of the interior of the AMV apparatus 3.0 to effect total coverage of the interior spaces, with two interior communication audio speakers means 91, two interior occupant voice microphones means 92, to effect coverage of the interior spaces of the AMV apparatus 3.0, and two internal reading lights means 93 of sufficient power to illuminate the interior spaces for video observation, and a single LCD video display screen means 94 to communicate with, monitor the condition of, and otherwise provide two way audio and visual communications between the AMV apparatus 3.0 rescue personnel and the rescued occupants. All of the video and audio components are common items known in the art and are chosen on the basis of their durability under harsh conditions of search and rescue operations. Mounting and hook up for operation is accomplished by methods known in the art.

Figure 27:
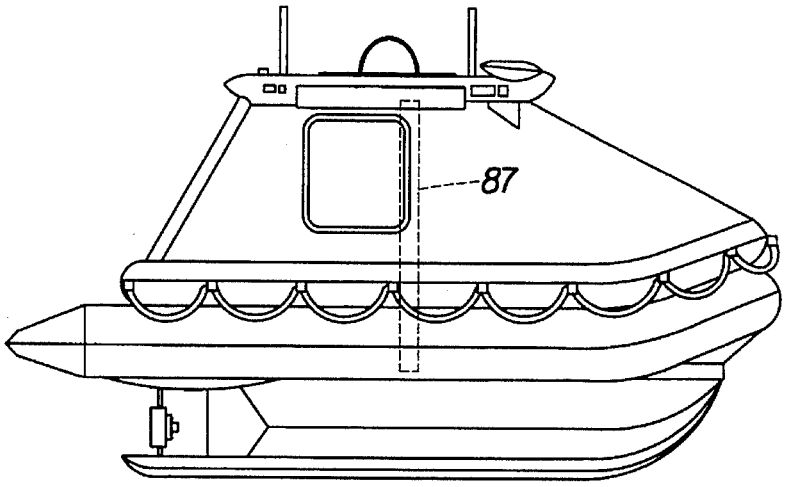
FIG. 27 is a side profile view of the AMV apparatus depicting the hardshell antenna housing and inflatable hull and weather hood erection and weight transfer device.

The hardshell antenna housing assembly 3D also incorporates a ship or helicopter skyhook connector hoop means 86 mounted externally to assist in recovery of the AMV apparatus 3.0. The hardshell antenna housing assembly also incorporates means to receive one end of a weather hood erection and weight transfer device means 87 shown in FIG. 27, generally comprising a rigid tube supported vertically between the recessed deck panel 36 of the rigid hull assembly 3A, and the antenna housing bottom mounting board 89, being hingedly attached to the antenna housing bottom mounting board so as to be self-placing, directed into place by gravity upon inflation of the inflatable hull and weather hood assembly 3B. The preferred embodiment contemplates a tube made of aluminum for the weather hood erection and weight transfer device means 87. The hardshell antenna housing assembly 3D also incorporates an external strobe light means 88, to assist in locating, and avoiding uncontrolled physical contact, with the AMV apparatus 3.0.

The navigation and control of the AMV apparatus 3.0 of the preferred embodiment of the present invention is further augmented by several devices mounted on the front (toward the bow) and rear (toward the stern) of the rigid antenna housing 81, as shown in FIG. 23, to monitor search, navigation, and boarding rescue activities. The devices include two exterior video cameras means 95; a Raytheon® navigation and collision avoidance radar 96 with radome antenna housing means 97 mounted on the topside surface of the rigid antenna housing means 81; an external high gain voice and audio detection sensor means 98 typical of those manufactured by Speech Technology Research Ltd.; a thermal-infra red sensor 99 typical of those manufactured for the M-16 rifle by Hughes Electro-Optical AN/TAF-13 with a thermal electric cooler chip; a forward oriented fixed position halogen external area light 100; a camera, light, and sensor washing spray nozzle means 101; and an exterior voice and siren megaphone 102 to provide the vehicle operator with internal or external real-time two way video and audio relay with the AMV Apparatus 3.0 and persons in the adjacent waters or within the interior cabin space of the AMV Apparatus 3.0 pertinent to rescue operations, navigation, and obstacle avoidance. Unless noted, all the navigation and control devices are those that are common and known in the art. Mounting and operation is as would be to those skilled in the art.

Further to the preferred embodiment of the present invention, the sides of the rigid antenna housing means 81 also incorporate port and starboard exterior navigation lighting means 103, and two auto self righting inflation mechanisms 104 being mounted respectively on each side of the rigid antenna housing means 81, typical of those manufactured by Zodiac Hurricane Technologies Incorporated.

The preferred embodiment of the AMV apparatus 3.0 incorporates a control, navigation, and collision avoidance system 3F, shown disposed in the rigid hull 34 in FIG. 21, comprised of a CPU computer and electronics module 118, an ARGOS satellite one way store-transmit data telemetry card 119, typical of those manufactured by Seimac Ltd.; a combined STARSYS, INMARSAT, or IRIDIUM two way real-time satellite data telemetry card 120 typical of those manufactured by Seimac Ltd.; a GPS satellite dynamic self positioning and tracking card 121, typical of those manufactured by Seimac Ltd. under the trade name Smart Cat; computer memory storage device 122; a two way RF radio data and voice transceiver communications card 123, typical of those manufactured by Motorola; a radar card 124, typical of those manufactured by Titan Radar Systems; a subsurface collision avoidance sonar transducer and card 125, typical of those manufactured by SIMRAD Inc.; AMV autonomous/semi autonomous navigation, vehicle systems, and mission control software 126, typical of that developed by International Submarine Engineering; and AMV apparatus thruster control actuators, typical of those developed by International Submarine Engineering; a thermal sensor signal processing card 127, typical of those manufactured by Hughes Electro Optics; and an audio sensor signal processing card 128 typical of those manufactured by Speech Tech. Research Ltd. All of the above system elements are configured and operated in a manner known to those skilled in the art.

The CPU computer and electronics module 118 is electrically connected to the AMV apparatus 3.0 electrical system 3G which is comprised of a photovoltaic cell array 82, shown in FIG. 23, an alternator means 129, which charge a set of NI-Cad, or lead acid marine batteries 130, which then distribute a 12- to 24-volt regulated direct current charge of electricity to the various vehicle electrical and electronic systems.

Figure 32:
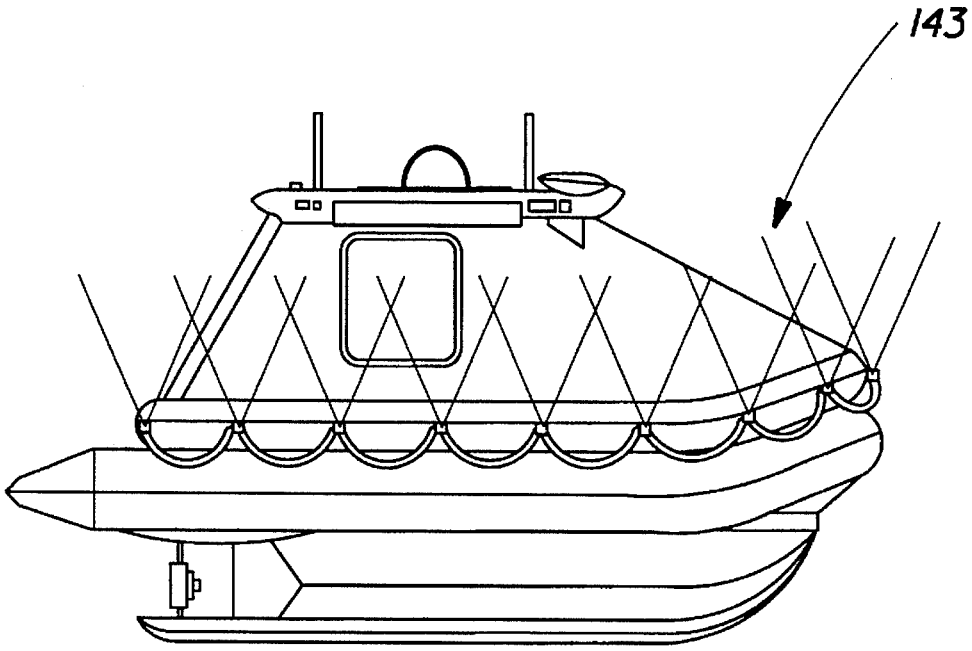
FIG. 32 is a profile view of the AMV apparatus depicting the upper and lower peripheral fire suppressant and cooling spray system.
Figure 35:
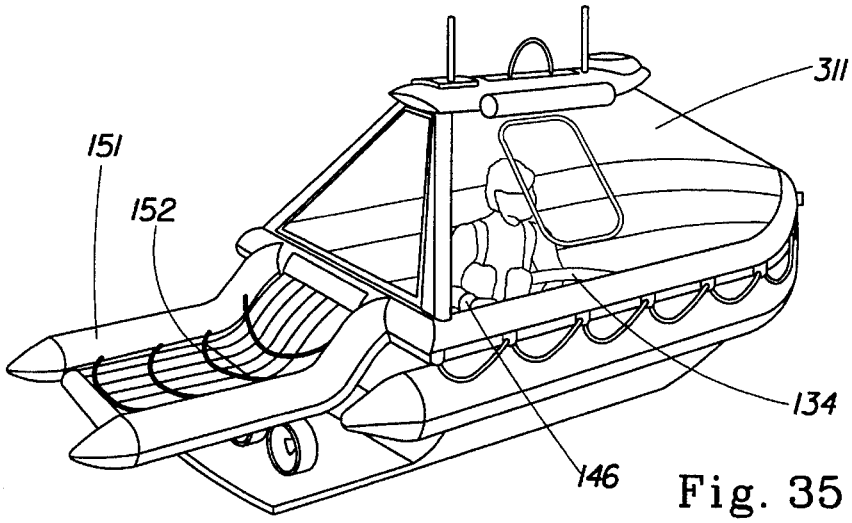
FIG. 35 is a translucent, perspective view of the AMV apparatus with an occupant connected to physiological vital signs wrist or ankle straps with survival suit heater ducts connected to the occupant.

The CPU computer and electronics module 118 is responsible for processing dynamic or proprogrammed instructions to effect actuation or termination of various vehicle activities and auxiliary system 3H, shown on FIGS. 21 and 22, comprised of the power pack means 105, driven hydraulic pump means 131 that provides high pressure hydraulic fluid to charge a master hydraulic actuator module 132, which drives the alternator 129 shown in FIG. 22, to provide electricity for a heater 133 shown schematically in FIG. 21, which provides heat to several personal survival suit heater ducts 134, as shown on the occupant in FIG. 35; a vehicle polar insulation liner 73; a salt water desalination system means 135 that produces potable drinking water stored in freshwater reservoir tanks 136, which are equipped with a water quality sensor and filter 137. The hydraulic pump means 131 and master hydraulic actuator module 132 can either power directly or indirectly through the electrical generator means, an air compressor means 138, used for maintaining the inflated portions of the AMV apparatus 3.0 and for charging a rapid inflation bottle 139, or for deflating the inflatable hydraulic and pneumatic lift assembly 4A shown in FIGS. 1 through 6. The air compressor means 138, is also capable of being directed by the CPU computer and electronics module 118 to respond to signals received from a low pressure activation sensor, typical of those manufactured by Dunlop-Beaufort Ltd., and in lieu of using the rapid inflation bottle 139 can also pump air directly into the hydraulic and pneumatic lift assembly 4A. The master hydraulic actuator module 132 is also used to actuate water pumps means for bilge, cleaning, and fire protection 141, that also power the high-pressure spray cleaning system 142, and fire protection and periphery spray system 143, shown in FIGS. 32 through 34.

Further preferred embodiments contemplated is the auxiliary system 3H can be directed by the CPU computer and electronics module 118 to respond to various vehicle system sensors means such as water temperature, which are standard capacitance-measuring sensors of existing design, and environmental life support sensors such as cabin temperature, and individual physiological vital signs such as wrist strap sensors 146, shown being used in FIG. 35, of existing design.

Figure 2:
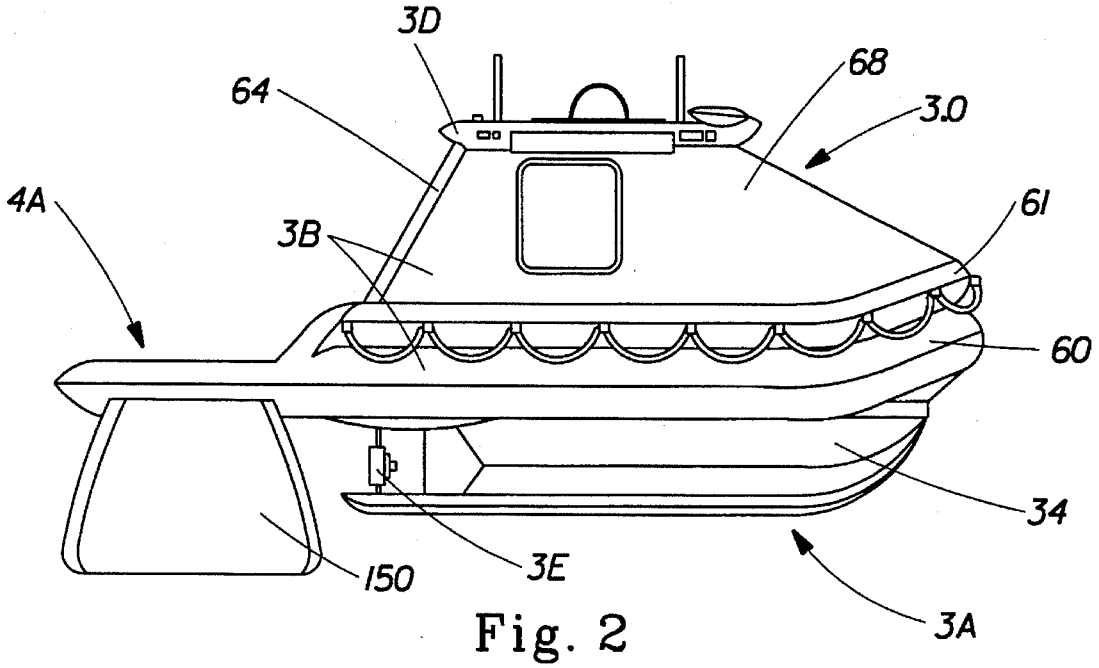
FIG. 2 is a side profile view exhibiting overall AMV apparatus configuration with inflatable hull and weather hood assembly in place and hydraulic and pneumatic lift assembly extended in the horizontal plane.
Figure 4:
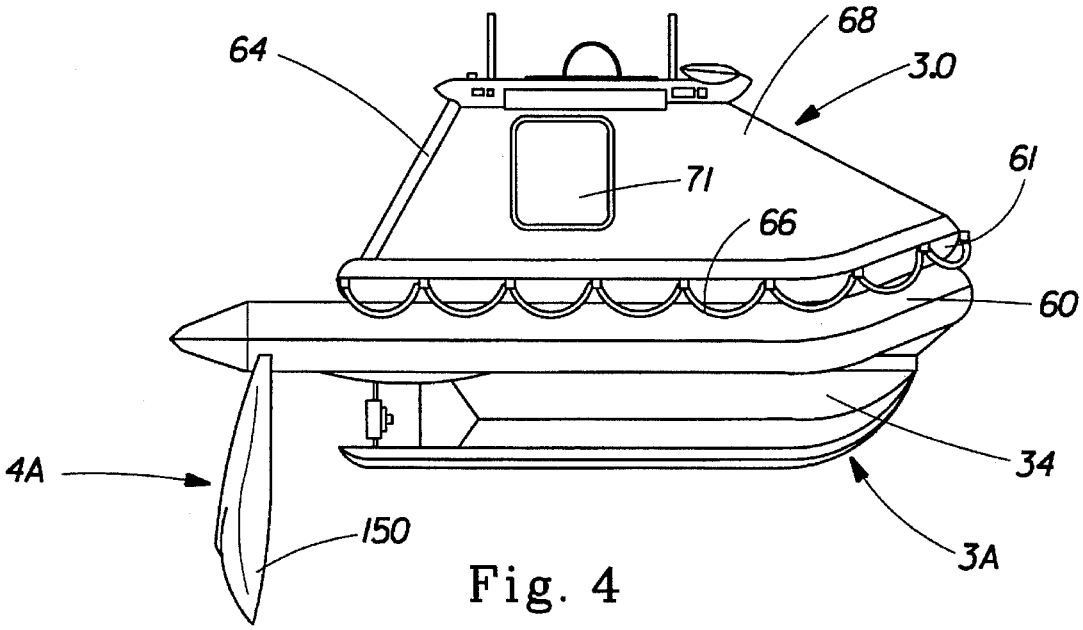
FIG. 4 is a profile view exhibiting overall AMV apparatus configuration with inflatable hull and weather hood assembly in place and hydraulic and pneumatic lift in a deflated condition in a vertical plane.
Figure 5:
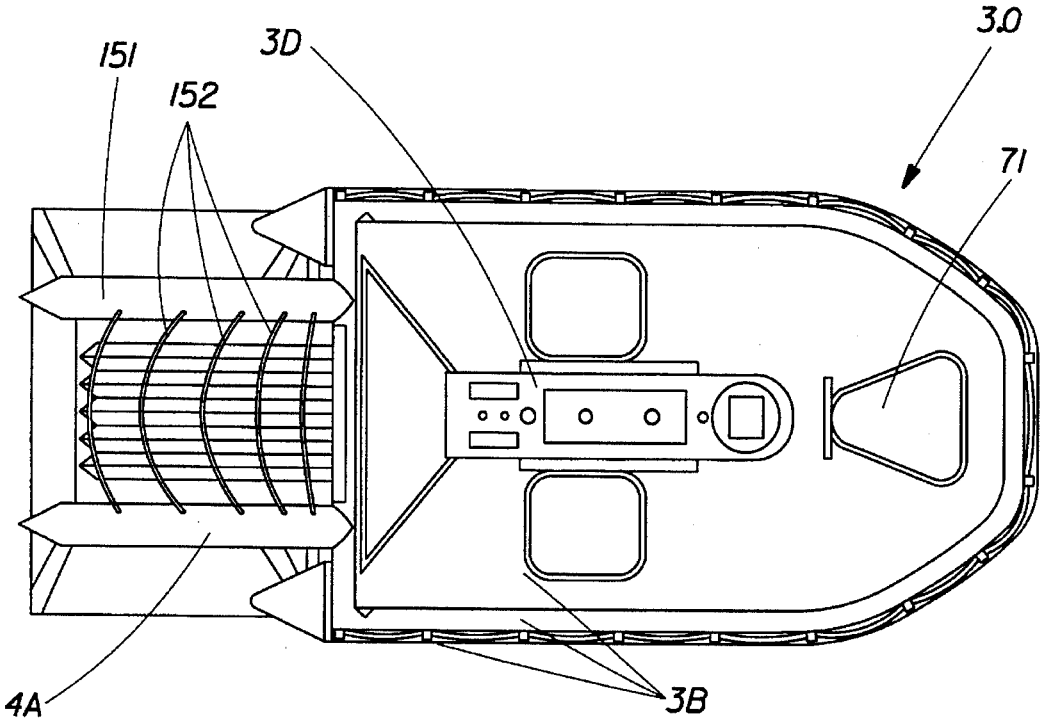
FIG. 5 is a plan view exhibiting overall AMV apparatus configuration with inflated weather hood housing in place and hydraulic and pneumatic lift inflated and extended in the horizontal plane.
Figure 6:
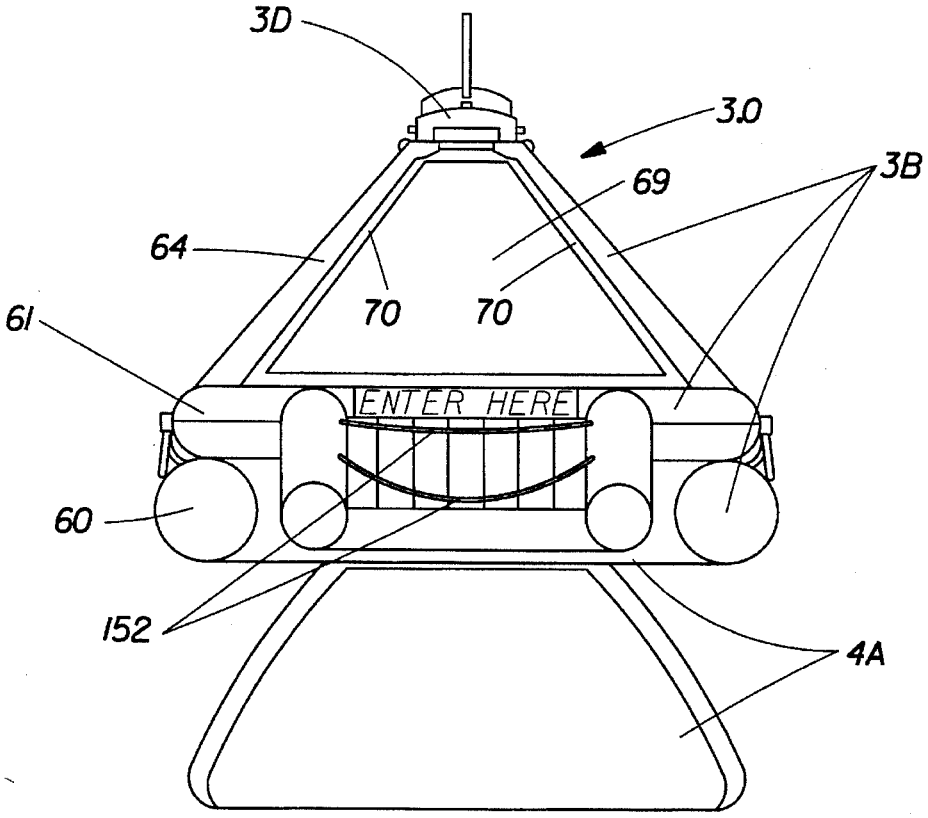
FIG. 6 is an external rear view of the AMV apparatus in an inflated condition with hydraulic and pneumatic lift inflated and extended in the horizontal plane.
Figure 7:
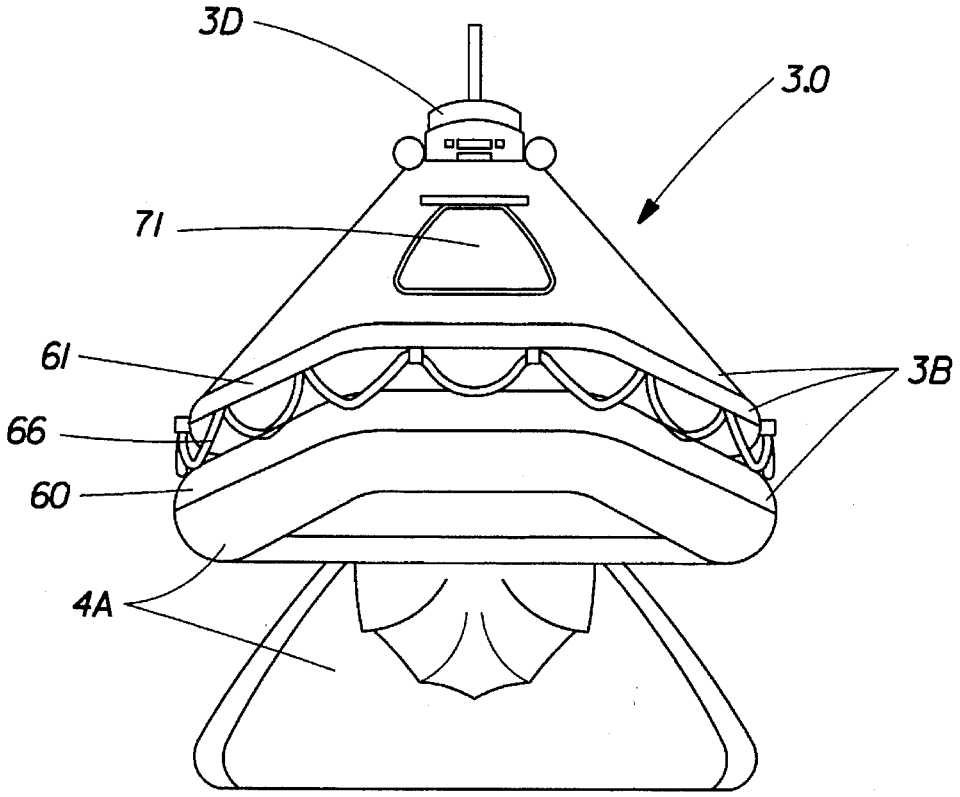
FIG. 7 is an external frontal view of the AMV apparatus in an inflated condition.
Figure 36:
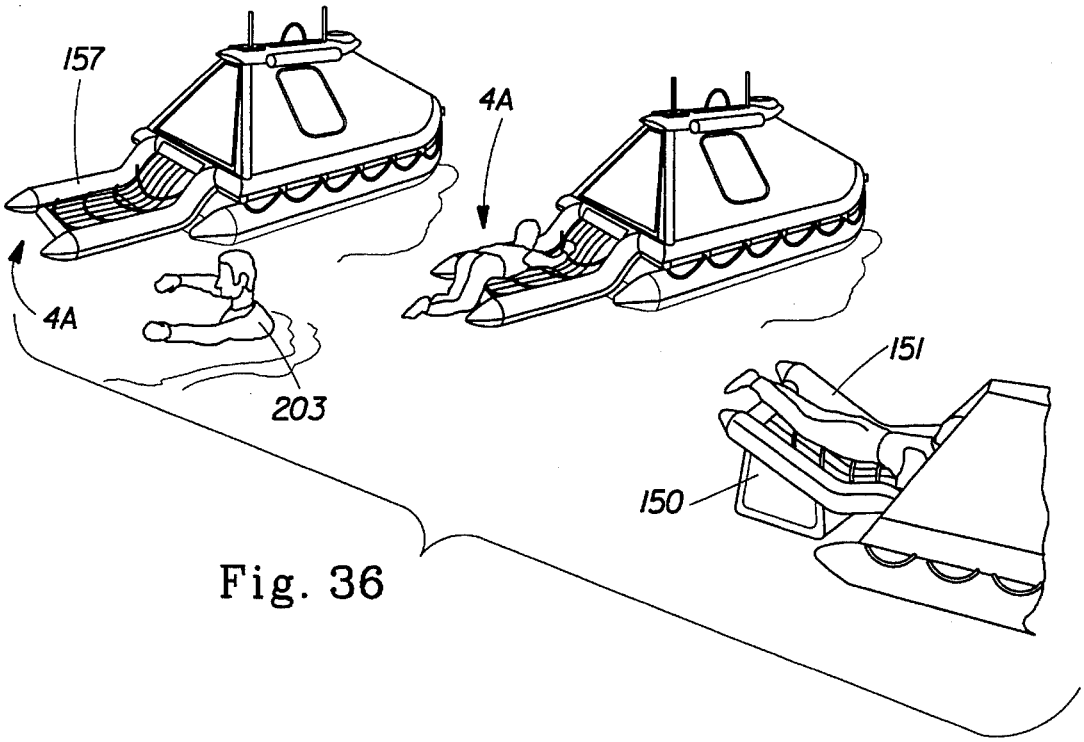
FIG. 36 is a three-sequence perspective view of the AMV apparatus depicting a deflated hydraulic and pneumatic lift assembly with victim in water, victim grasping onto recovery chute hand rope rungs with chute in partially inflated condition, and victim sliding forward on recovery chute with recovery chute fully inflated.
Figure 36A:
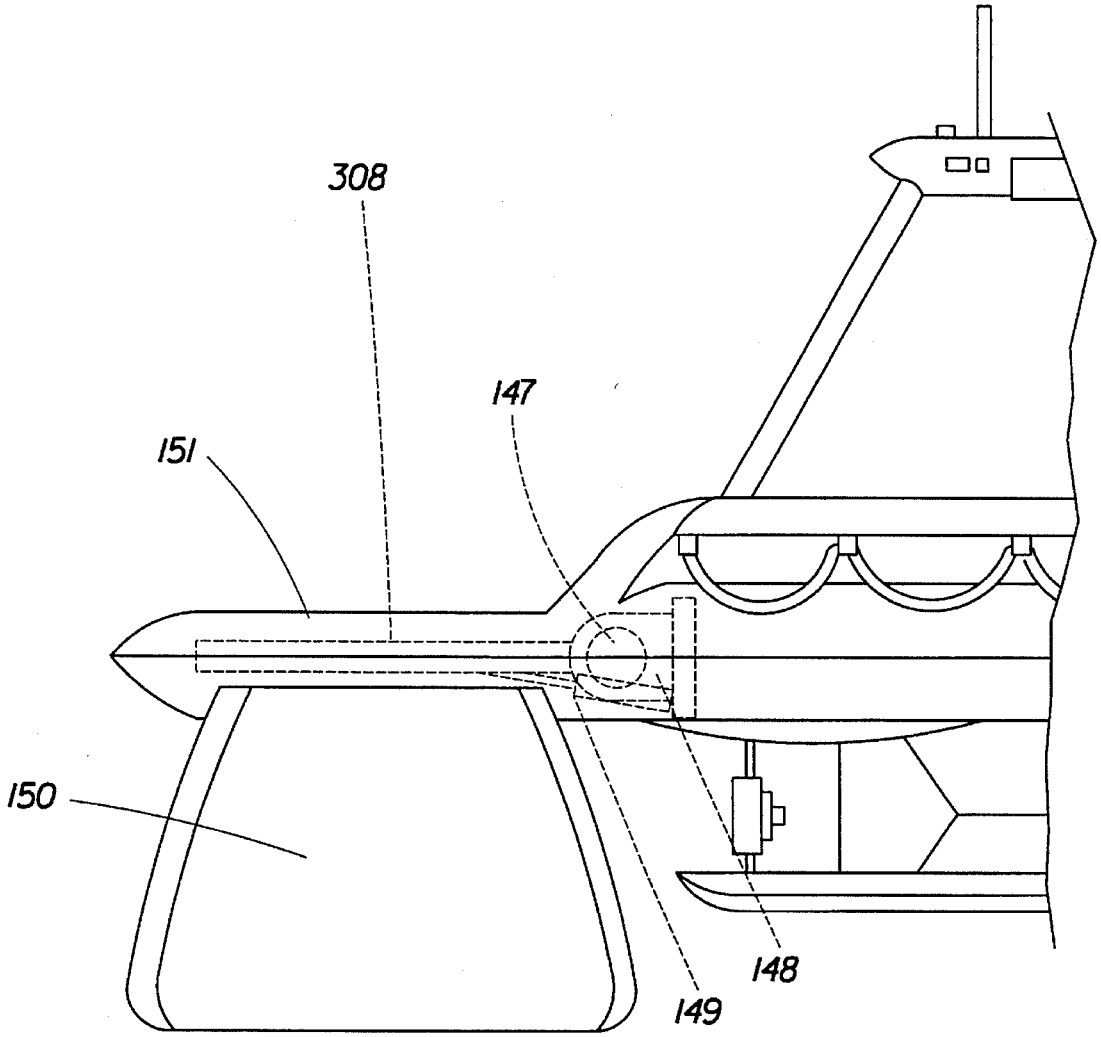
Figure 37:
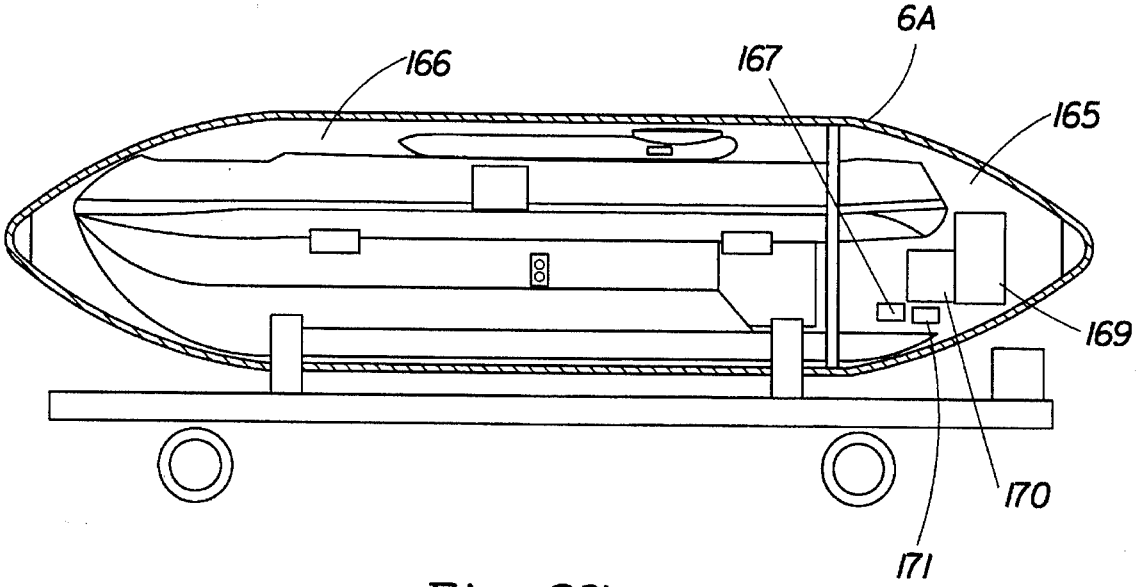
FIG. 37 is a side view of the AMV apparatus air deployment container system packaged prior to deployment.

The preferred embodiment of the present invention incorporates a personnel recovery means 4.0, comprising a hydraulic and pneumatic lift assembly 4A, shown in FIGS. 1 through 6, and in operation in FIG. 36 and 36A, for the purpose of recovering persons suffering physical weakness, injuries, or hypothermic loss of motor coordination. The personnel recovery means 4.0 is attached to the transom of the AMV apparatus 3.0 and is comprised of two main elements. First is a robotic arm means 308 which provides lifting support for the person being recovered and is capable of lifting weight in excess of 400 pounds. The robotic arm means works in conjunction with the inflatable recovery chute 151 and can be moved through 140° in the vertical axis from a generally vertical position as shown in FIG. 4, to a generally horizontal position as shown in FIG. 2. This movement is effected by a hydraulically rotated axle assembly 147 that is connected to a a transom-mounted mechanical shoulder assembly 148, which is in turn connected to, and actuates, a pair of hydraulically extendible cylinder arm assemblies 149 to assist in the directional control and lifting effort of the hydraulic and pneumatic lift assembly 4A. The inflatable recovery chute 151 serves as a cushioned bed to lift the rescued person 203 out of the water and into the AMV apparatus 3.0. The second main element is the recovery chute rapid inflation lift bags means 150. The rapid inflation lift bag means 150 is affixed under the inflatable recovery chute 151 and pneumatically connected to the rapid inflation bottle 139 that provides quick inflation to lift the inflatable recovery chute 151 so as to incline the inflatable recovery chute 151 in such a way so as to facilitate easy entry of the person being rescued to the AMV apparatus 3.0 interior cabin space as shown in FIG. 36. Inflatable recovery chute hand rungs 152 are provided to assist the rescued person in getting positioned on the inflatable recovery chute 151. The materials and construction of the pneumatic inflatable portion of the personnel recovery system are same as used for the inflatable hull and weather hood assembly.

The preferred embodiment of the present invention also incorporates an ensemble of survival gear and provisioning supplies 5A, their storage position shown in FIGS. 21 and 22 comprised of food provisions; several units of canned or plastic bags of water; a first aid kit; a fishing gear kit (line, lures, tackle); multilingual survival and operating instructions; personal survival suits; waterproof distress and illumination flares; waterproof flashlights and batteries; and a waterproof hand-held 2-way radio transceiver; All of these items are such as are common and known in the art.

The preferred embodiment of the present invention further contains an ensemble of maintenance supplies 5B, their storage position shown in FIGS. 21 and 22, comprised of a multi-purpose mechanical tool kit; multilingual operating and maintenance manuals; and an inflatable hull repair kit; All of these items are such as are common and known in the art.

Figure 11:
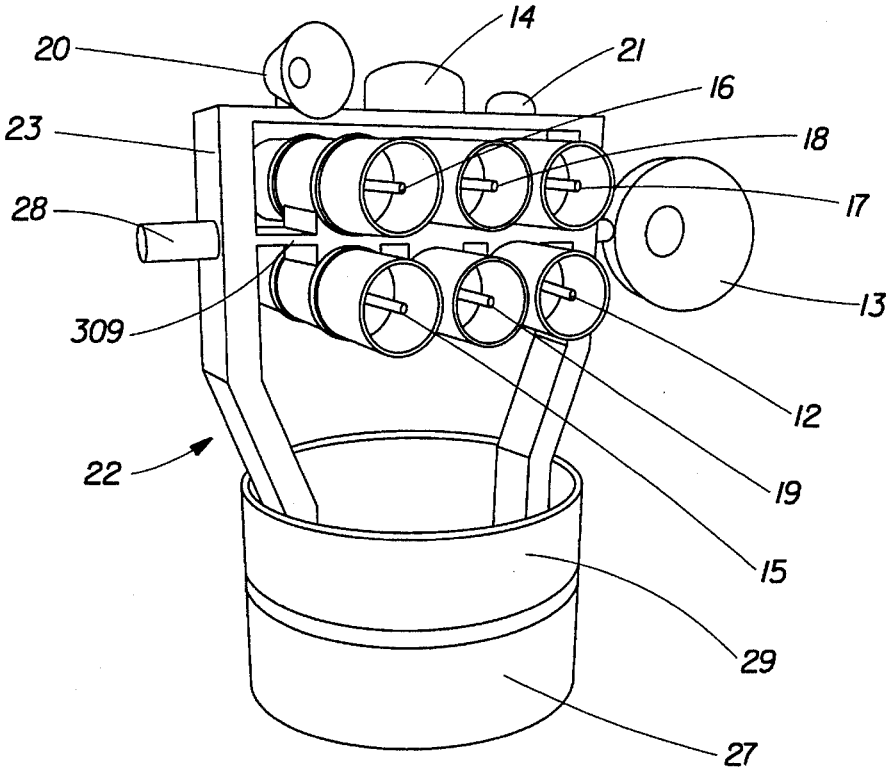
FIG. 11 is perspective view, of a detection and targeting sensor array apparatus depicting enclosure, pylon tracking device, and internal sensor components configuration in accordance with the present invention.
Figure 12:
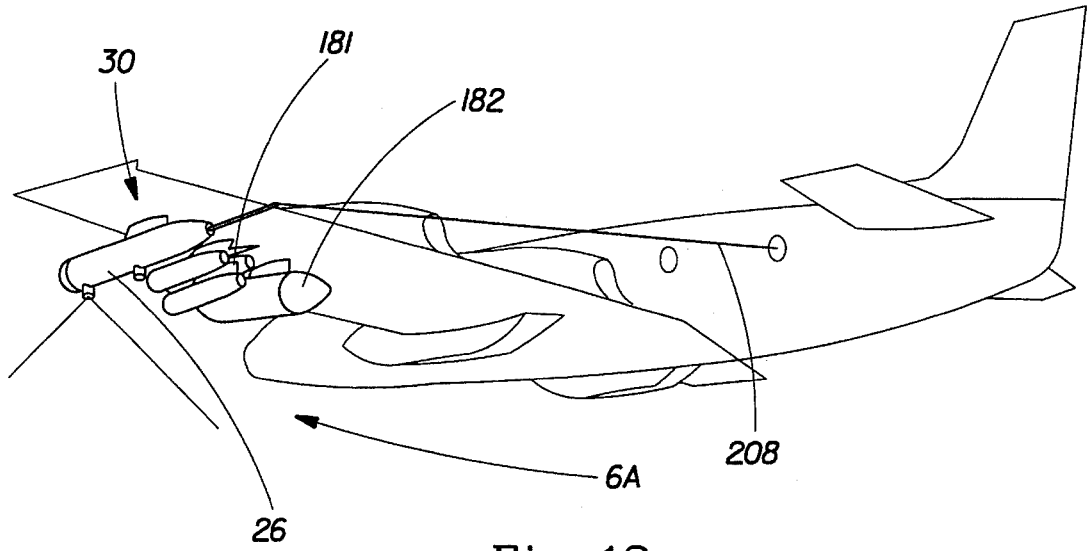
FIG. 12 is perspective view of a CP-140 Lockheed Aurora detection and targeting sensor array apparatus depicting enclosure, wing hardpoint pylon mounting, and infra red data link to aircraft components configured in accordance with the present invention.

The preferred embodiment of the present invention further incorporates target data gathering from the targeting and sensor array apparatus 2.0, shown in FIG. 11 for land or sea embodiments. FIG. 12 shows the airborne embodiment of the targeting and sensor array apparatus 2.0, the elements of which are disposed within a SAMSON® wing-mounted pod, communication being effected by the use of an infra-red telemetry link to the operator on board the aircraft 208. The elements of the targeting and sensor array apparatus 2.0 shown in FIG. 11 will be used to delineate the elements of the array. The targeting and sensor array apparatus is used to detect persons needing rescue and to effect precise deployment positioning of the AMV apparatus 3.0 through the use of a thermal-infra red imaging sensor means 12 typical of those manufactured for the M-16 rifle by Hughes Electro- Optical AN/TAF-13; an audio detection sensor means 13 typical of those manufactured by Speech Technology Corp.; radar imaging sensor means 14 typical of those manufactured by Titan; standard laser imaging sensor means 15; standard video sensor means 16; enhanced night video sensor means 17 typical of those manufactured Bausch and Lomb; laser ranging sensor means 18 typical of those manufactured by Regal Lasers; and user definable radiometric ranging sensor means 19 typical of those manufactured by KDH Industries, Inc.; with standard audio megaphone means 20, all of which, to facilitate field repairs and sensor interchangability, are integrated into a vertically rotatable Sensar® tube mounting rack means 22, comprised of generally horizontal Sensar tube mounting platform 309 similarly rotatably coupled to the vertically rotatable mounting rack means 22. A series of standardized 5 inch cylindrical Sensar tubes means 23 are mounted on the Sensar tube mounting platform 309. The Sensar tube mounting rack is rotatably mounted on and coupled to a central pylon means 27 with rapid response two directional horizontal tracking actuator and stepper motor and actuator assembly means 29. The generally horizontal Sensar tube mounting platform 309 is similarly coupled to a rapid response two directional vertical azimuth tracking actuator and stepper motor assembly means 28. The vertical and horizontal stepper motor means, 28 and 29, facilitate the undertaking of user-defined automated scanning sequences, or response to user-defined GPS, azimuth, or rotational tracking position bearings through use of the tactical AMV and sensor array control console assembly apparatus 1.0, shown in FIG. 8; mounted joystick, pen, trackball, keyboard, or mouse interface means 4; hardware switching devices means 5; software switching devices means 6; and a directional control pad such as the URC-100 manufactured by ACR Electronics 7. The mounting and hook up of the elements of the targeting and sensor array means is as would known in the art by one skilled in the art.

Figure 9:
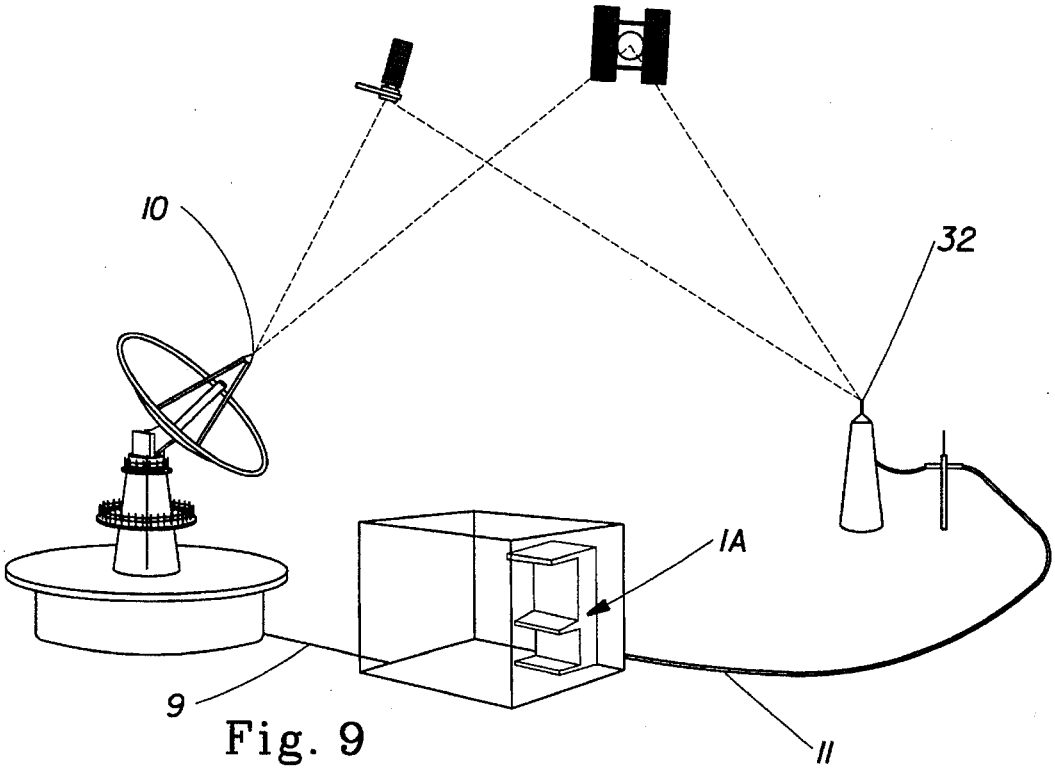
FIG. 9 is a perspective view, of a tactical control console apparatus casing, mounted within a rescue coordination center (RCC) with hardwired armored relay cable to both radio (RF) and satellite antenna configurations connected to a remotely controlled lighthouse detection and targeting sensor array in accordance with the present invention.
Figure 10:
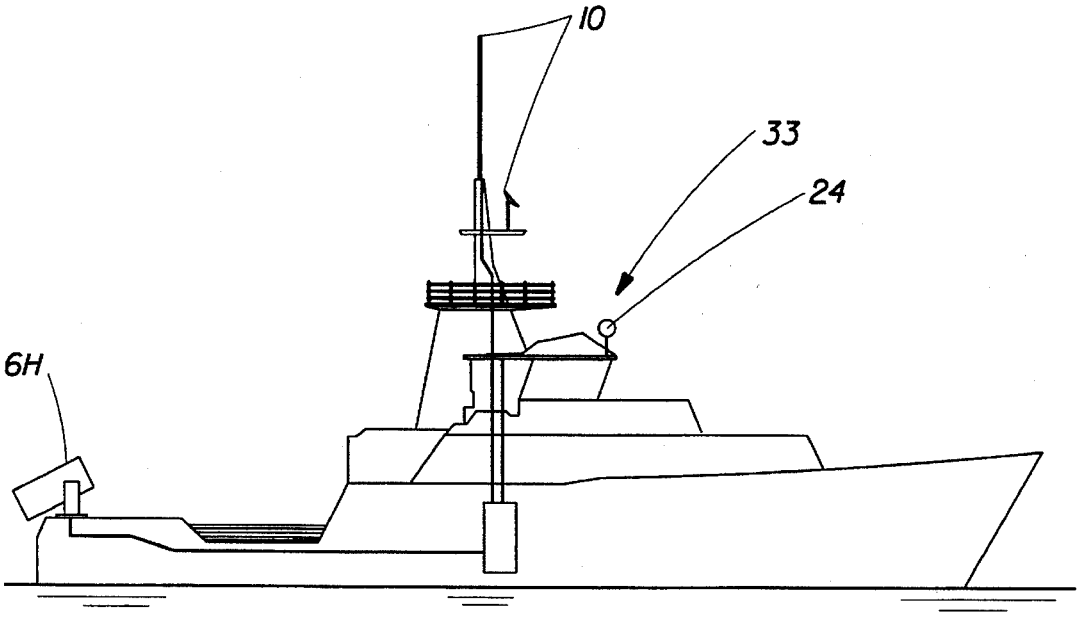
FIG. 10 is a perspective view, of a tactical control console apparatus casing, mounted on board a Canadian 500 Series Coast Guard Cutter with hardwired armored relay cable to both radio (RF) and satellite antenna configurations connected to the tube launch system and detection and targeting sensor array in accordance with the present invention.
Figure 13:
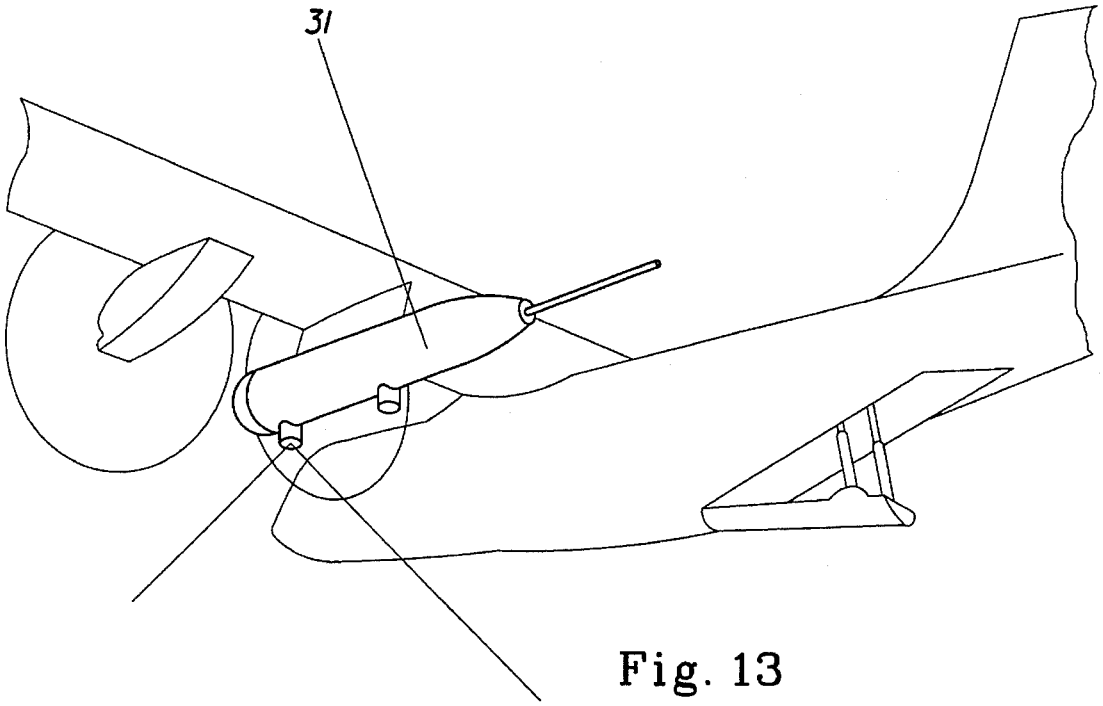
FIG. 13 is perspective view, of a C-130 Lockheed Hercules detection and targeting sensor array apparatus depicting Special Avionics Mission Strap-On Now (SAMSON®)) (TM of Lockheed-Martin Aeronautical Systems) pod enclosure, wing hardpoint pylon mounting, and infra-red data link to aircraft components configured in present invention.
Figure 14:
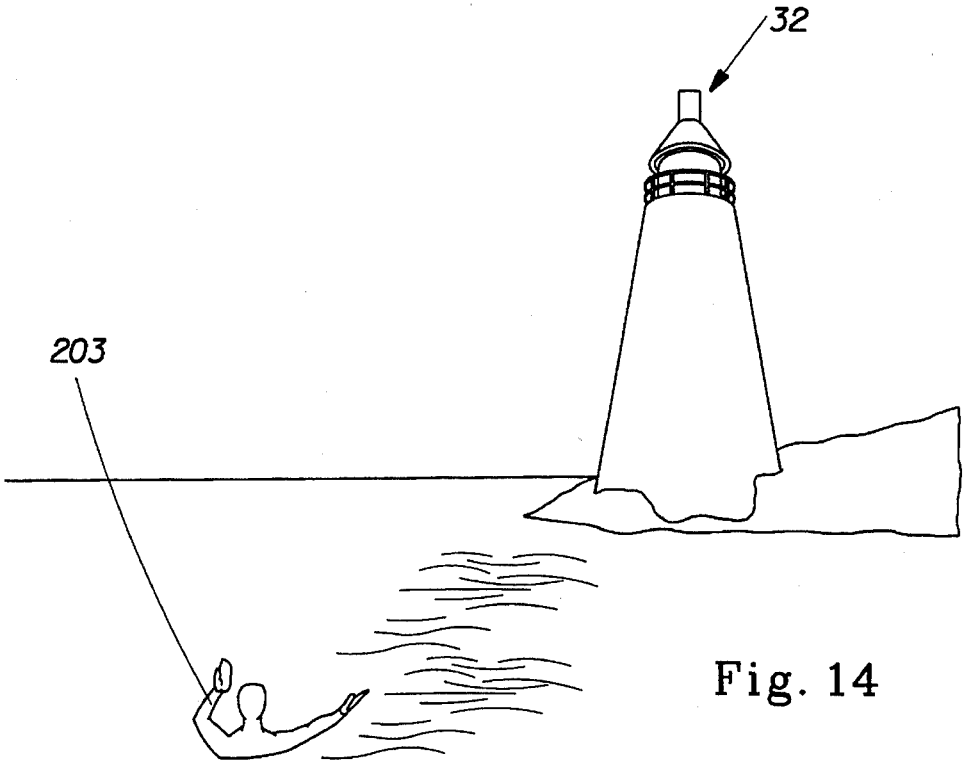
FIG. 14 is a perspective view of a typical shore based lighthouse detection and targeting sensor array apparatus.

Telemetry data can be relayed to or from the targeting and sensor array means in a variety of configurations, including, for example, a CP-140 aircraft detection-targeting sensor array apparatus 30, shown in FIG. 12; C-130 aircraft detection-targeting sensor array apparatus 31, shown in FIG. 13; a lighthouse detection-targeting sensor array apparatus 32, shown in FIG. 14; a ship and oil rig detection-targeting sensor array apparatus 33, shown in FIG. 10; or through radio, and satellite telemetry antennas means 10, or hardwired land based telephone lines, or ship based armored connection cable means 11 as shown in FIG. 9.

Figure 8:
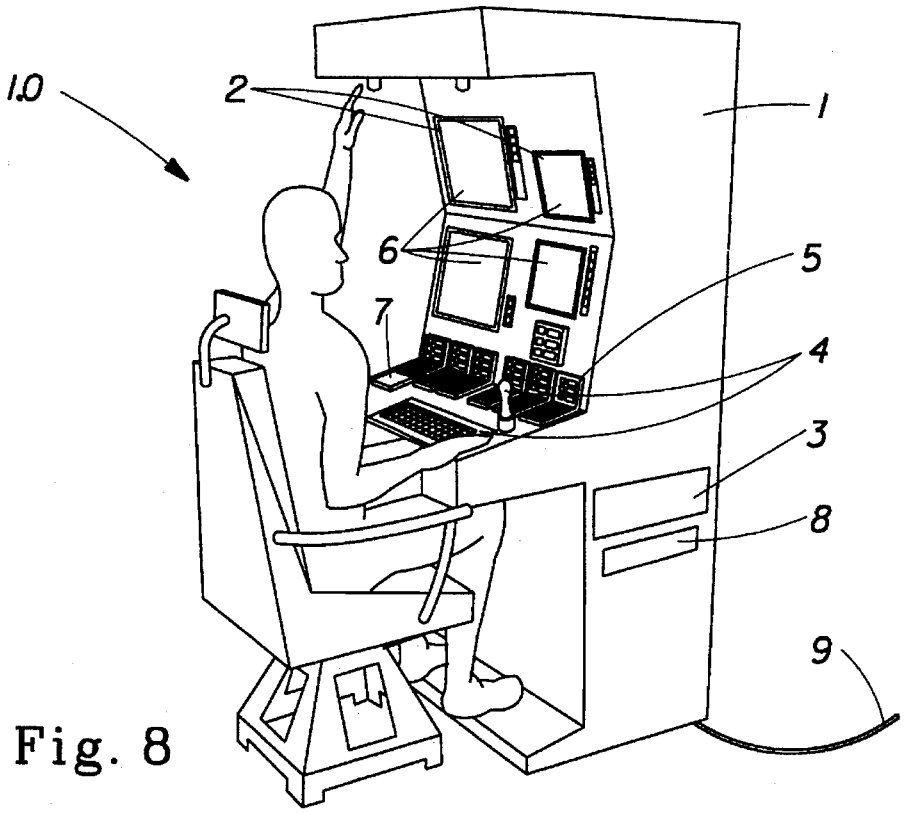
FIG. 8 is a perspective view, of a tactical control console apparatus casing, user interface mechanisms, control devices, and data relay antenna cable configuration in accordance with the present invention.

The AMV apparatus 3.0 and targeting and sensor array 2.0 are controlled by a tactical AMV and sensor array control console assembly 1.0, shown in FIG. 8. The tactical AMV and sensor array control console assembly includes a ruggedized aircraft, ship, submarine, oil rig or ground-installed computer and electronics main casing means 1 with LCD or CRT graphic user interface visual displays means 2 to permit real-time viewing of raw or processed data which is channeled through the expert system CPU and electronics processing hardware and software means 3 to display video images and other data transmitted from the subject AMV apparatus 3.0 or from the targeting and sensor array assembly 2.0; to enable monitoring, or manipulation of the AMV apparatus 3.0 and the targeting and sensor array apparatus 2.0 through a joystick, pen, trackball, keyboard, or mouse interface means 4; hardware switching devices means 5; software switching devices means 6; and a hardware based directional control pad means 7. These devices effect input of user defined instruction signals to the AMV apparatus 3.0 and the targeting and sensor array apparatus 2.0, by a data telemetry transmitter means 8, and antenna relay cable means 9, shown in FIG. 9, connected to ship, oil rig, aircraft, or shore based radio, and satellite telemetry antenna means 10, shown in FIG. 9, or hardwired ship based armored relay cable means or conventional telephone land line connection relay cable means 11, shown in FIG. 9, to the targeting and sensor array apparatus 2.0, shown in FIG. 11, or the land based ejection rail AMV casing release actuator means, or ship and oil rig based ejection tube AMV release actuator means, shown in FIG. 10.

The preferred embodiment of the AMV apparatus 3.0 is capable of being land, air or sea deployed from a variety of stationary and mobile delivery platforms. The preferred means among these platforms for timely delivery response time is air deployment, which is comprised of either an internal or external delivery system encompassing an aeronautically engineered cylindrically shaped air deployment casing (ADC) assembly 6A, shown in FIG. 37. The ADC provides an interior space for the stored, uninflated AMV apparatus 3.0 and is comprised of a rear ADC cone section 165, a forward ADC section 166, front and fear ADC section separation actuator means 167, front and rear casing section position lights means, ADC inspection access panels means 169, ADC remote starting test interface panel means 170, ADC remote starting test interface jacks means 171, ADC lift handles means, AMV recovery parachute assembly means, a recovery parachute deployment actuator means, water and/or mechanically actuated recovery parachute separation switch means, and a recovery parachute strap cutter disconnect mechanism means. All components of the ADC are such as are known in the art and are manufactured by Irvin Industries Ltd. Canada, or Paratronics.

Figure 38:
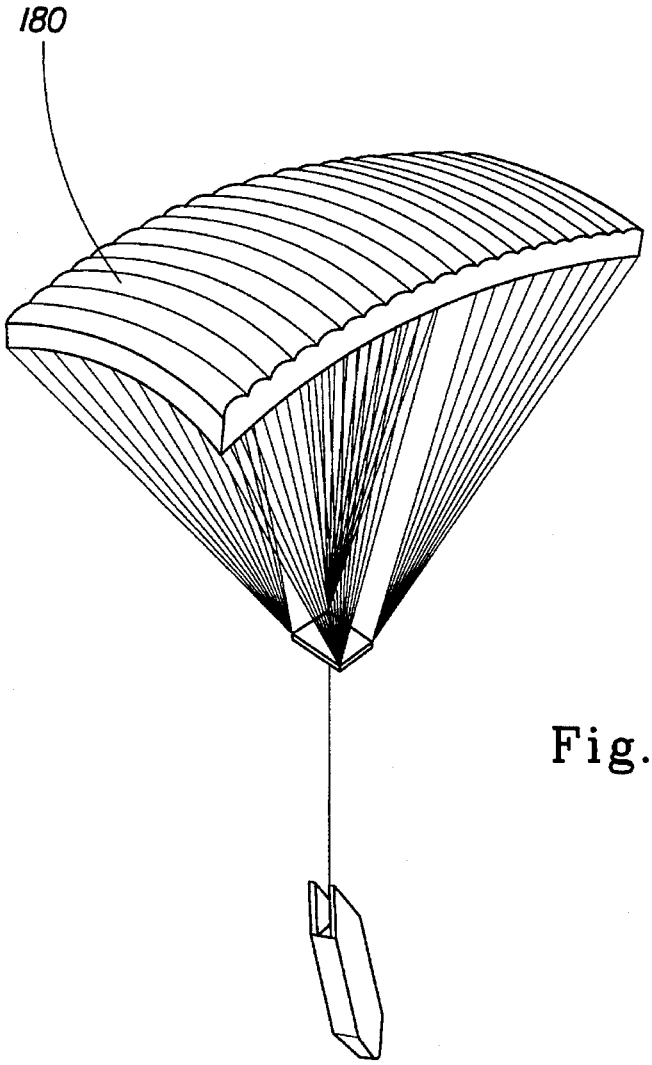
FIG. 38 is a perspective view of the AMV apparatus air deployment container system after deployment depicting the components of the active steering control recovery chute system assembly.
Figure 39:
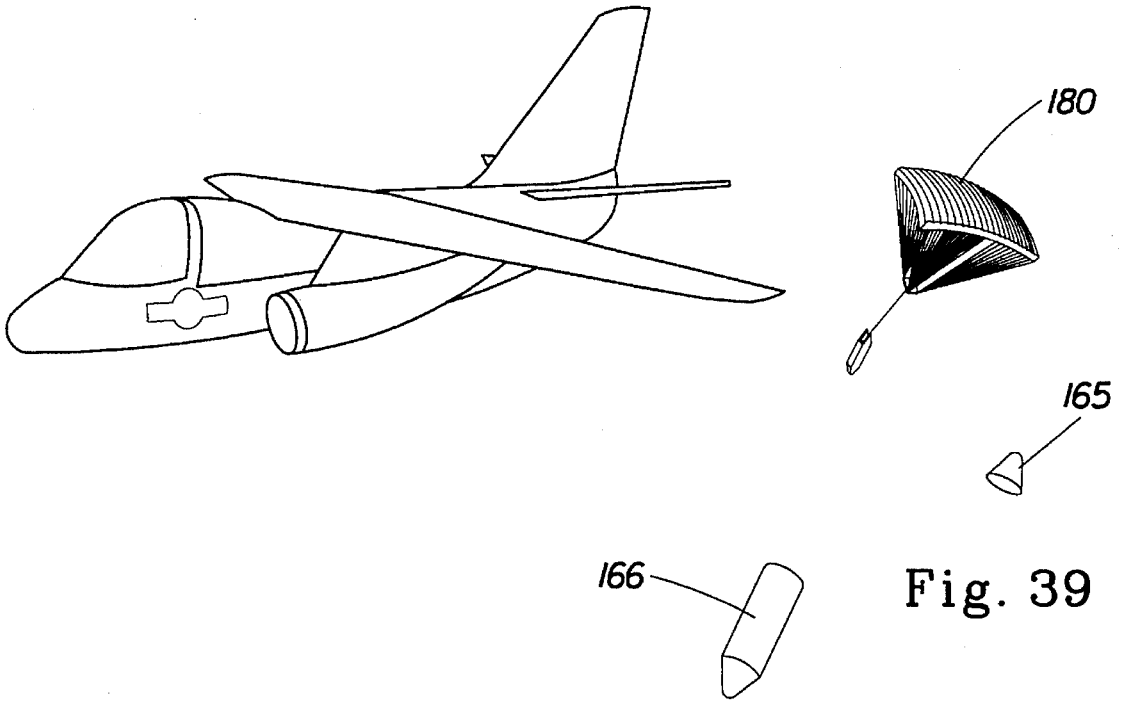
FIG. 39 is a perspective view of the AMV apparatus air deployment wing mounted external container system incorporating an aircraft deployable version of the apparatus of the present invention.

When air deployed, upon separation from the ADC 6A, the descent of the AMV apparatus 3.0 in the preferred embodiment of the present invention is effected by incorporating a low velocity air drop (LVAD) active steering control recovery parafoil (ASCRP) assembly 6B, typical of the Orion precision guided delivery system manufactured by FFE Incorporated, shown in FIGS. 38 and 39, to effect a precision parafoil landing at a dynamically selected laser designated, GPS correlated target, or a preprogrammed GPS designated target. This is accomplished through the use of a dynamic laser and GPS navigation module means, an aircraft based guidance telemetry receiver and antenna means, parafoil steering control actuators means, and a steering control actuated parafoil 180.

Figure 40:
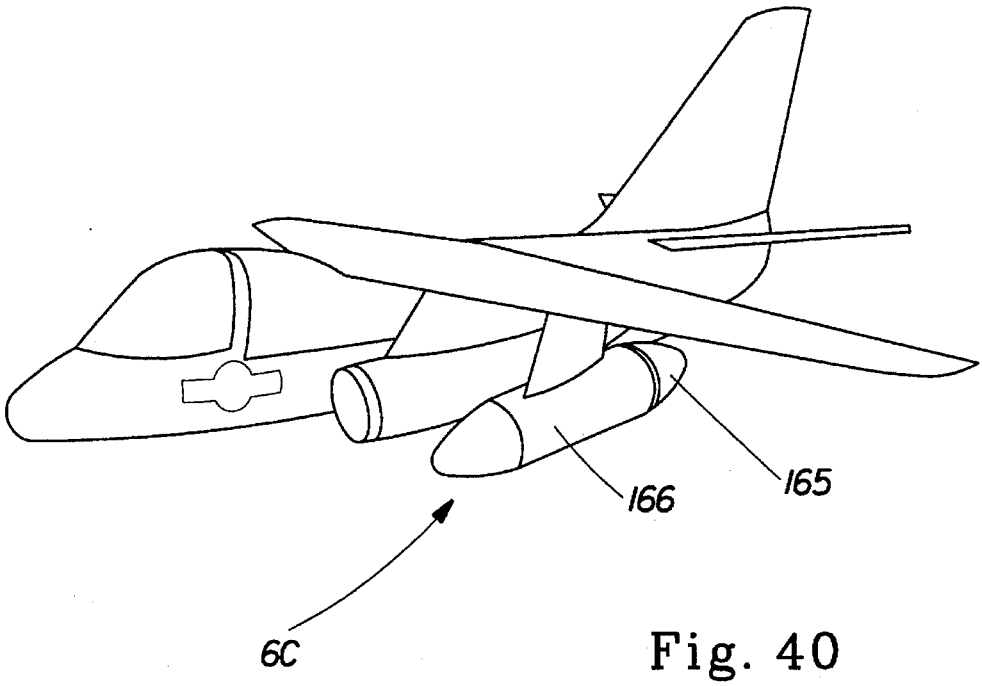
FIG. 40 is a perspective view of a single full size AMV apparatus air deployment container system mounted on a wing hardpoint of a Lockheed S-3 Viking.
Figure 41:
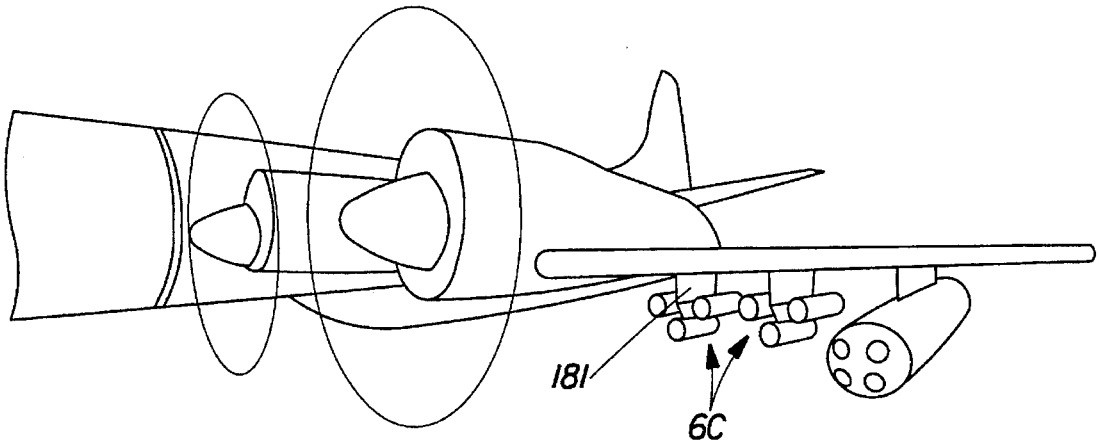
FIG. 41 is a perspective view of three reduced size AMV apparatus air deployment container systems mounted on two externally mounted air deployment system TER-7 triple ejector rack assemblies mounted on two Lockheed CP-140 Aurora aircraft wing hardpoint systems with one detection and targeting SAMSON® pod mounted on a single outboard CP-140 wing hardpoint.

The preferred embodiment of the present invention of the AMV apparatus 3.0 includes external air deployment by one of two methods that incorporate an externally mounted aircraft deployment system (XMADS) 6C, shown in FIGS. 12, 40 and 41, typical of a Lockheed CP-140 Aurora or P-3 Orion, a Lockheed S-3 Viking, a Sikorsky SH-60 Helicopter or other type of aircraft with external ordinance payload capabilities possessing a wing, fuselage, or bomb bay, equipped Triple Ejector Rack (TER-7) 181, as is standard NATO or U.S. Air Force design, shown in FIG. 12, capable of carrying three reduced size embodiments of the AMV apparatus 3.0, and can also utilize a single point aircraft wing or fuselage hardpoint pylon with BRU-11 bomb rack 182, typical of U.S. Air Force or NATO design, shown in FIG. 40, capable of carrying and deploying a full size embodiment of the AMV apparatus 3.0. The components of the externally mounted aircraft deployment system work in conjunction with the ADC in a manner known in the art upon ejection from the aircraft to effect the separation of the rear cone casing and parachute actuator means for successful deployment of the AMV apparatus 3.0.

Figure 42:
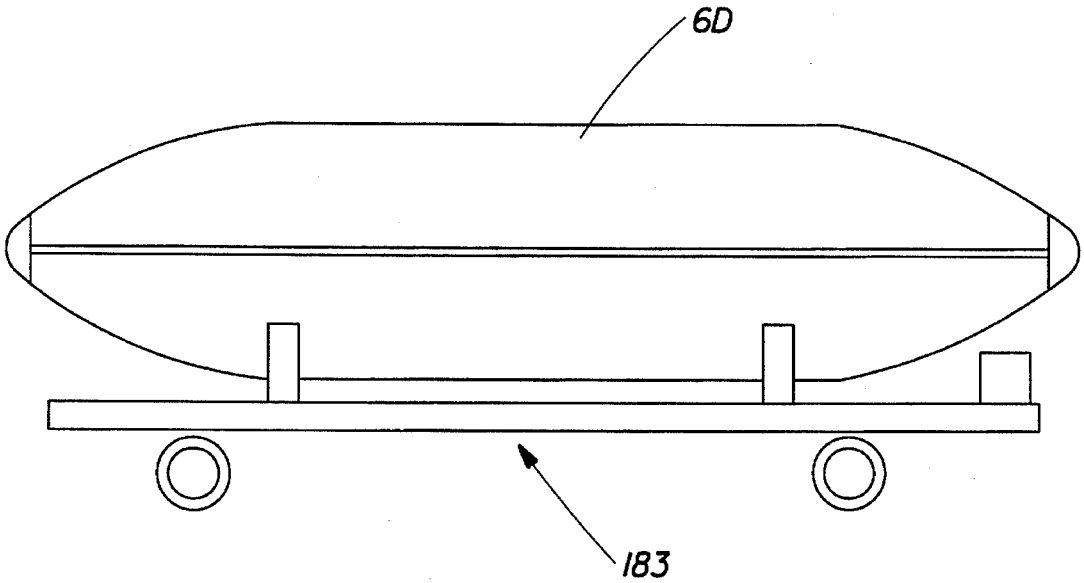
FIG. 42 is a side view of the AMV apparatus air deployment container system mounted on an internally mounted cradle deployment system packaged prior to deployment.
Figure 43:
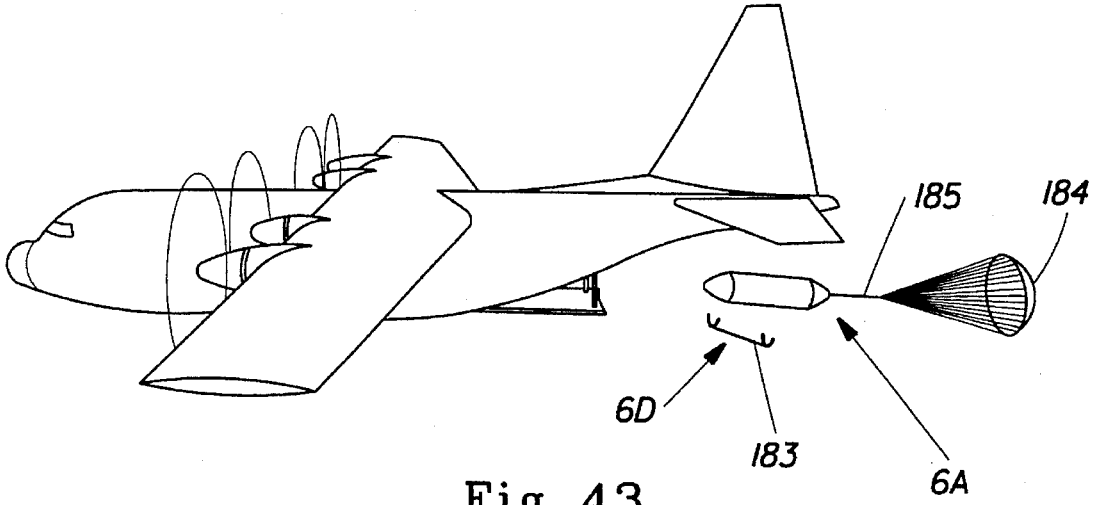
FIG. 43 is a perspective view of the AMV apparatus and air deployment container system incorporating an aircraft deployable version of the apparatus of the present invention being deployed from the rear of a Lockheed C-130/L-100 air deployment platform incorporating an internally mounted air deployment system with extraction chute extended.

Another embodiment of the present invention contemplates one method of air deployment which incorporates an internally mounted aircraft deployment system (IMADS) 6D, shown in FIGS. 42 and 43, comprised of a disposable ADC deployment cradle means 183, which is attached to an ADC 6A extraction parachute sub assembly means 184, such as that manufactured by Irvin Industries, with an ADC deployment activation cord means 185, attached to the air deployment casing assembly means 6A. As depicted in FIG. 43, and as is common in the art, the disposable ADC deployment means 183 is pulled out of the rear access of the aircraft by an extraction parachute sub assembly means 184, typical of those manufactured by South-Tek International. Once out of the aircraft the disposable ADC deployment cradle means 183 falls away allowing the ADC 6A containing the AMV apparatus 3.0 to open and deploy just as if externally deployed, as shown in FIG. 39.

Figure 44:
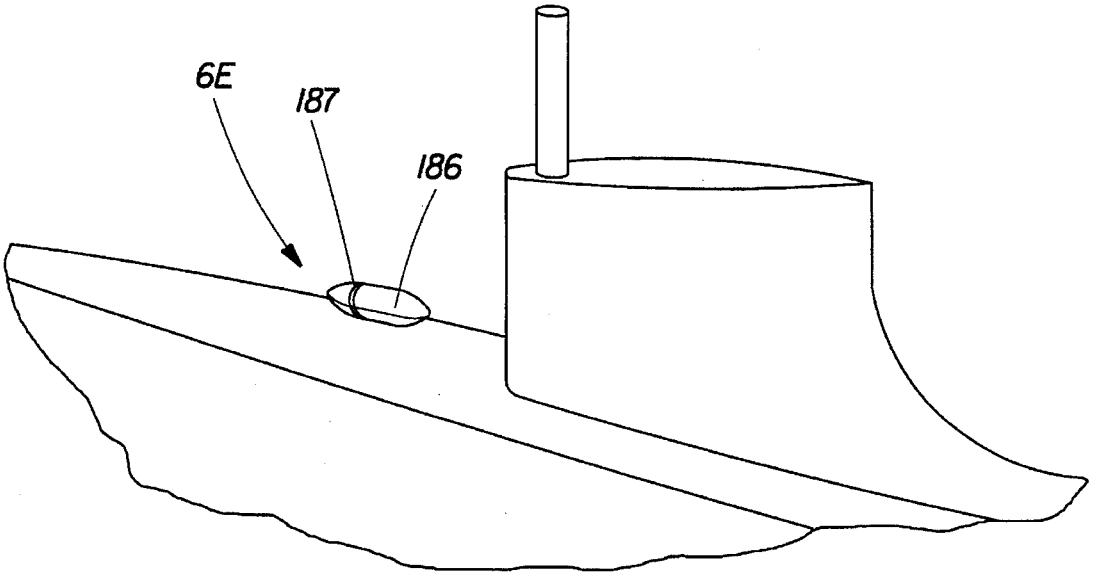
FIG. 44 is a perspective view of the AMV apparatus pressure rated subsurface deployment casing container system mounted externally on the deck of a U.S. Navy Seawolf class nuclear submarine.

The preferred embodiment of the present invention of the AMV apparatus 3.0 also includes one method of subsurface sea deployment which incorporates a pressure rated submarine deployment casing (PRSDC) assembly 6E, shown in FIG. 44, which is engineered to withstand the hydrodynamic pressures associated with a given depth rating enabling it to ride externally on a submarine hull, torpedo tubes, or other submarine pressure hull orifice ejection system means, or within a diver lockout chamber to be deployed to the surface for the purpose of personnel rescue incorporating a top PRSDC section 186, bottom PRSDC section means 187, a PRSDC externally mounted submarine release device means 188, and a PRSDC separation actuator means 189. The bottom PRSDC section 187 and the top PRSDC section 186 are joined together along their longitudinal axes with a casing sealing and incorporates a user initiated, or depth-sensitive separation actuator means. All the elements of the pressure rated submarine deployment casing assembly are such as those developed and manufactured by International Submarine Engineering and known in the art.

Figure 45:
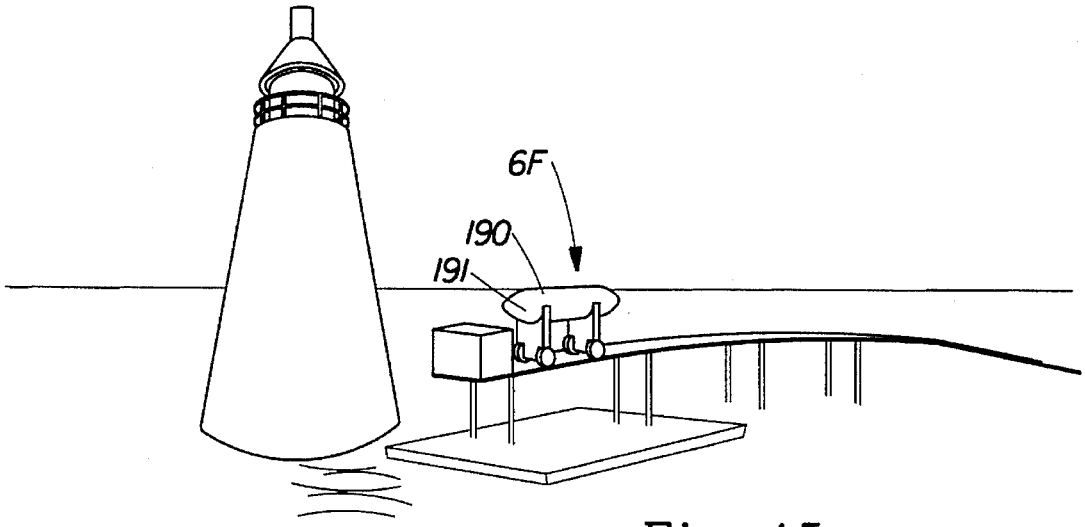
FIG. 45 is a perspective view of the AMV apparatus depicting a deployment casing with a rail launch system mounted on a land based concrete foundation for remotely actuated automated lighthouse deployment.

The preferred embodiment of the present invention also contemplates one type of land based rail deployment system 6H, which utilizes a shore deployment casing (SDC) assembly 6F, shown in FIG. 45. The SDC is comprised of a top casing section 190, a bottom casing section 191, a casing release device 192, and a casing separation actuator 193.

The embodiment of the present invention of the AMV apparatus 3.0 also includes one method of land based deployment which is comprised of a shore mounted launch system (SMLS) assembly 6G, shown in FIG. 45. The SMLS assembly is comprised of an ejection rail assembly 194, and an ejection rail AMV apparatus 3.0 casing release actuator means and an AMV apparatus 3.0 ejection rail compressed air launch device means. The shore mounted launch system operates in a similar fashion to the other launch methods once the shore deployment casing contacts the water. The shore deployment casing is similarly constructed and operated as the PRSDC, except that it need not be able to withstand severe hydrodynamic pressures.

Figure 46:
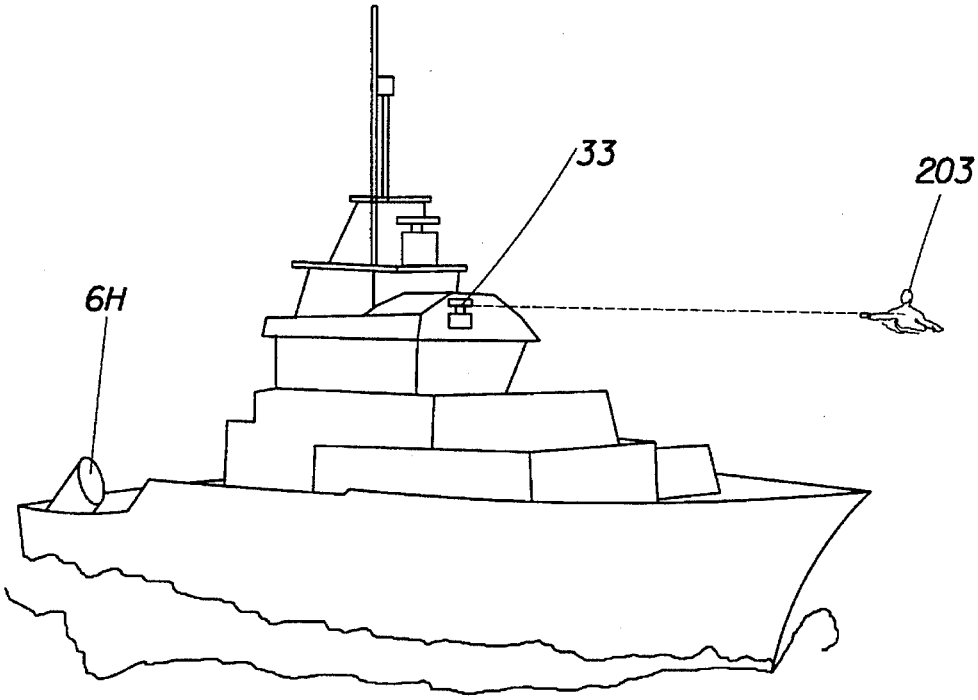
FIG. 46 is a perspective view of the AMV apparatus depicting an oil rig and ship mounted launch system tubular launch system fastened to a ship deck and being targeted by a ship mounted detection and targeting sensor array.
Figure 47:
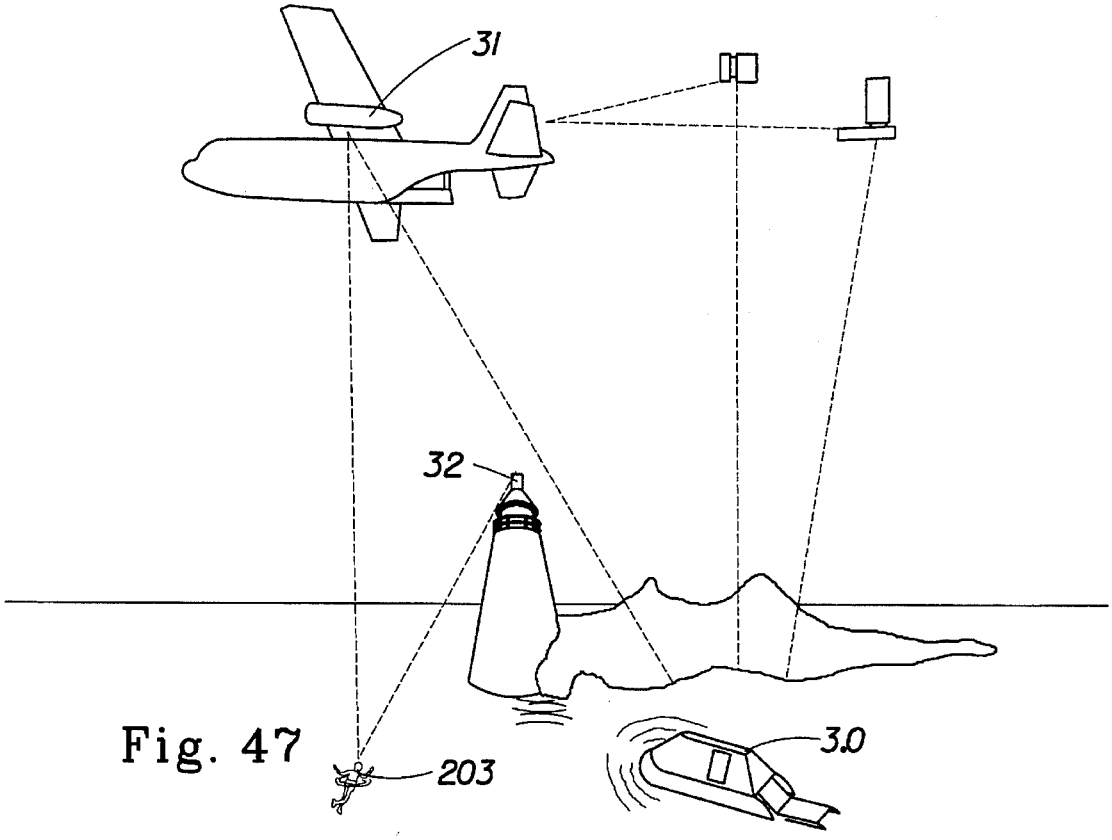
FIG. 47 is a perspective view of the AMV apparatus depicting land, ship and shore based telemetry typical of an GPS, INMARSAT, or STARSYS type satellite system with GPS positioning, radar and sonar collision avoidance system during a rescue operation.
Figure 48:
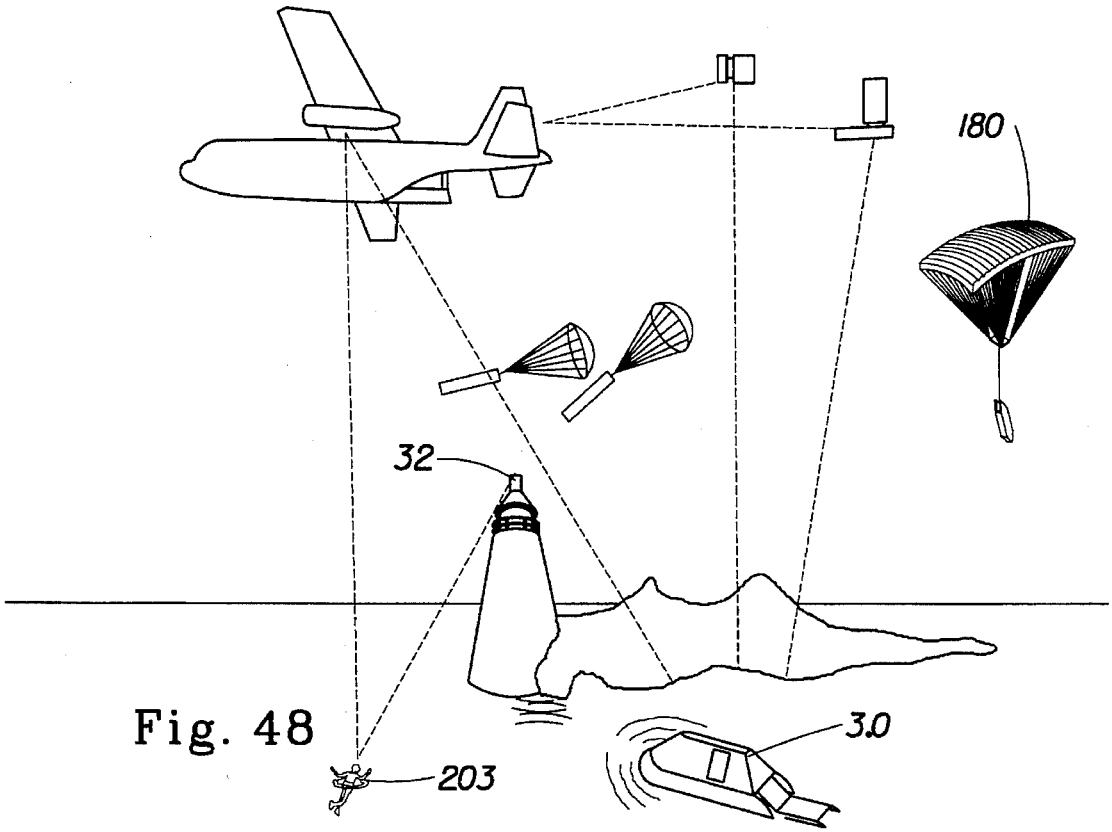
FIG. 48 is a perspective view of the AMV apparatus depicting several air, land or sea deployable versions of the apparatus of the present invention in parallel, semi autonomous and autonomous, operation in rescue roles and illustrating data and control telemetry typical of an INMARSAT, or STARSYS type satellite system with GPS positioning, radar and sonar collision avoidance system during a rescue operation.
Figure 49:
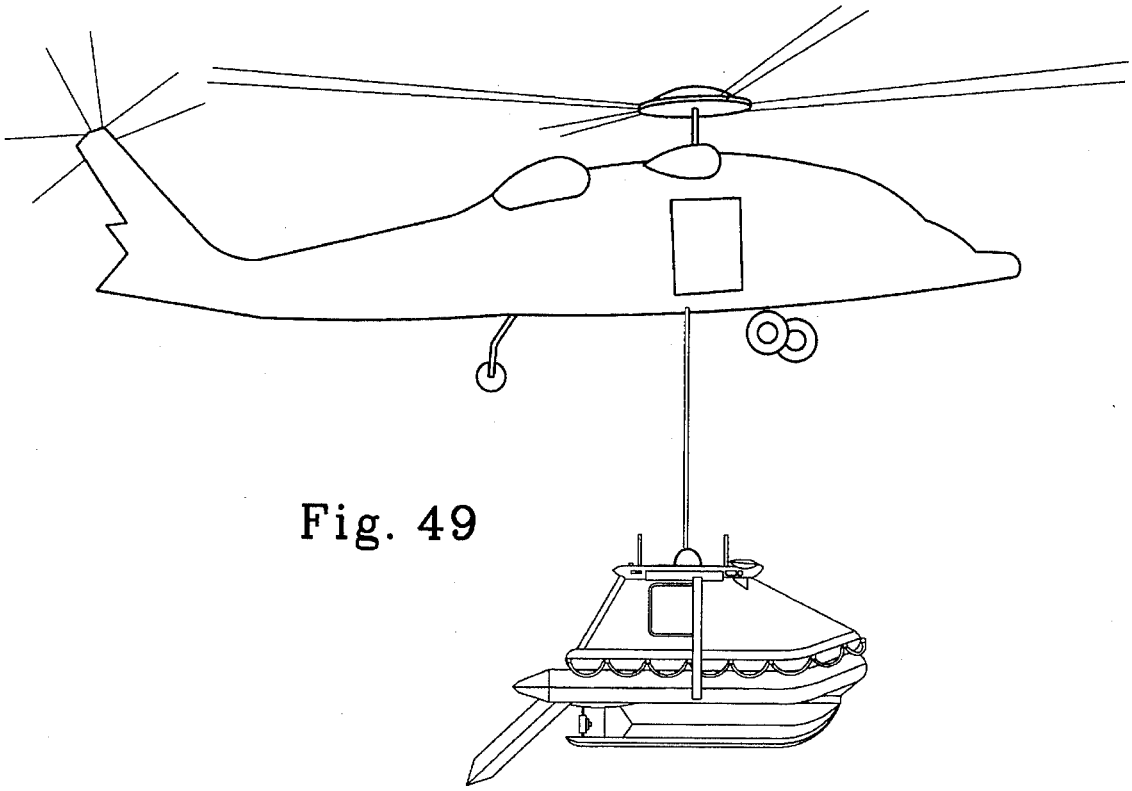
FIG. 49 is a perspective view of the AMV apparatus undergoing recovery by a Sikorsky SH-60 Jayhawk helicopter.
Figure 50:
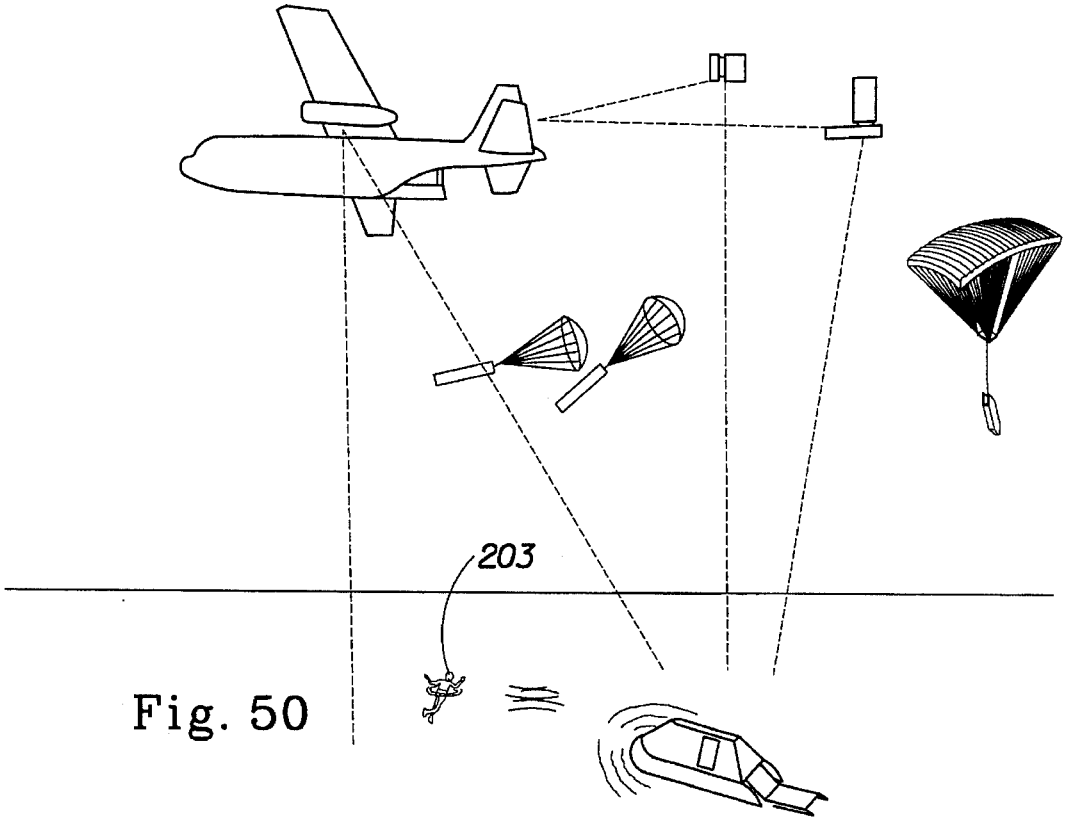
FIG. 50 is a perspective view of the AMV apparatus depicting utilization of either an internally mounted deployment system or externally mounted deployment systems with laser guidance, parachute separation actuator activation, and AMV apparatus undergoing inflation upon impact with the water surface.
Figure 51:
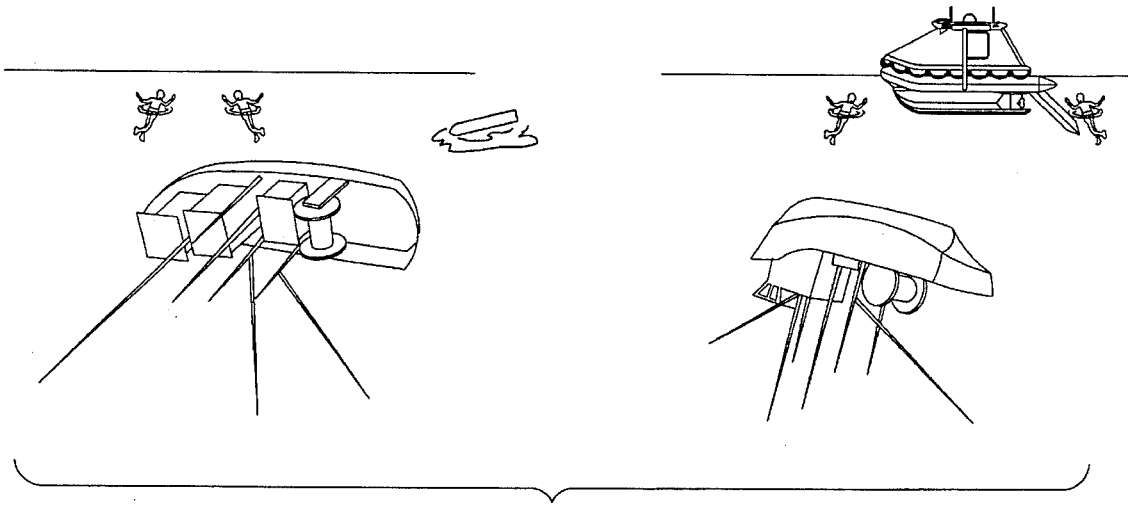
FIG. 51 is a perspective view of a sinking fishing boat or other vessel depicting automated release, inflation, and activation of the AMV apparatus of the present invention and subsequent autonomous emergency telemetry broadcast.

The preferred embodiment of the present invention also contemplates one method of surface sea deployment which comprises an oil rig and ship mounted launch system (ORSMLS) assembly 6H, shown in FIG. 46, comprised of an ejection tube assembly means, and an ejection tube AMV apparatus 3.0 release actuator means. The deployment and operation of the ORSMLS is similar with respect to its operation as to the other deployment systems delineated.

METHOD OF OPERATION

The invention will now be more clearly shown by way of method of operation. The FIGURES referred to are incorporated in this explanation of operation, as well as general FIGS. 47 through 51 that show the general operation of the parts of the system of the invention.

Upon detection or notification of a person in distress being located within the response range of a given land, air, or sea deployment platform a search is initiated using the targeting and sensor array assembly 2.0 to locate the persons in peril. The sensor array assembly 2.0 may be mounted on a ship, aircraft, or land based lighthouse, harbor or other facility. Upon detecting an individual in the water through use of thermal, laser scanning, audio detection, infra-red, standard video, night-illuminated video, or other sensor, the sensor array assembly 2.0 then calculates the GPS coordinates of the person in peril through a dedicated algorithm. The algorithm obtains the known GPS position of the ship, aircraft, or land based lighthouse, harbor or other facility platform to which the sensor array assembly 2.0 is mounted and calculates the targeting azimuth from the mounting position of the sensor array assembly 2.0, and obtains the distance to the person in peril target using laser, radar, acoustic, or other distance measuring means and then triangulates the GPS position of the person in peril.

The position data of the person in peril is then relayed via radio, satellite or hardwire cable telemetry to the AMV apparatus 3.0 and sensor control console 1.0 which contains software programming instructions to automatically generate a data log on the person in peril. The log on the person in peril may contain specific data about the sex, age, health, injuries and overall condition of the person in peril. The AMV apparatus 3.0 and sensor array control console 1.0 also relays operator designated timing interval instructions to the targeting and sensor array 2.0 in order to maintain automated tracking and periodic position updates on the target person in peril. Hardware and software operator interface devices mounted on the AMV apparatus 3.0 and sensor array control console 1.0 then enable the operator to initiate launch of the AMV apparatus 3.0 from either ship, oil rig, aircraft, lighthouse, harbor, or other deployment platform utilizing an ADC, SDC, or no casing through either a ASCRP 6B, PRSDC 6E, XMADS 6C, IMADS 6D, SMLS 6G, or ORSMLS 6H deployment system. When the exact location of a target person in peril is unknown, said AMV apparatus 3.0 may be deployed to undertake user designated search patterns or to initiate autonomous operation utilizing its on board sensor capabilities to explore potential location leads pertinent to finding the target person(s) in peril.

Wherein the AMV apparatus 3.0 is mounted on a ship, or oil rig, and the ship or oil rig sinks, the vehicle would be activated automatically through a pressure sensitive release switch which would bring the SDC to the surface where the AMV apparatus 3.0 would undergo inflation and initiate a series of preprogrammed self preservation and mission response commands. The programming would include power and propulsion systems start up with station keeping ability, cold start GPS fix on AMV apparatus 3.0 surface position, and an emergency radio and/or satellite transmission with live video, audio, and pertinent vehicle information. The information would be relayed to a rescue coordination center, ship, aircraft, or other platform equipped with the AMV and sensor array control station 1.0. Failing successful contact with the platforms or during the course of controlled and deliberate deployment, error code programming will initiate autonomous operations which include AMV apparatus 3.0 initiated search operations which use on-board sensor systems and particularly an audio detection system which has been trained to recognize human cries for help within the proximity of the vehicle while filtering out ambient noise caused by sinking ships, wild life, wind and other ambient noise which could interfere with the identification of a person's voice on the surface of the water.

When the AMV apparatus 3.0 is deployed from an aircraft, precise stand-off delivery to a programmed GPS waypoint can be effected through the use of a GPS guided parafoil system typical of those manufactured by Paratronics which can obtain stand-off deployment distances of 20 miles with 100 meter GPS waypoint splash down accuracy.

Risk of injury to a person in peril who comes into uncontrolled contact with the AMV apparatus 3.0 due to wave action or some other circumstantial influence is nominal because the AMV apparatus 3.0 is soft sided at the water level due to its inflatable hull and weather hood assembly 3B.

The AMV apparatus 3.0 upon locating or being directed to a person in peril can through operator based video observation assist a person in peril suffering hypothermia, injuries, or physical weakness to enter the AMV apparatus 3.0 interior cabin space through a personnel recovery system 4.0 comprised of a hydraulic and pneumatic lift assembly 4A. The hydraulic and pneumatic lift assembly 4A is capable of lifting a person with a nominal grasp on one of he inflatable recovery chute hand rungs, out of the water on an inflatable recovery chute thereby facilitating entry to the rear of the AMV apparatus 3.0.

Once the person(s) in peril (occupants) have been recovered the AMV apparatus 3.0 contains multi-lingual written instructions, prerecorded multilingual instructions, and also has the capability of relaying the operators voice to guide the occupants in matters of self preservation, first aid, vehicle handling procedures, and communications. The voice and video transmission between the operator and AMV apparatus 3.0 occupants is accomplished through radio and satellite based telemetry in real-time operation. The AMV apparatus 3.0 has the capability of sustaining life for several people through prepackaged survival provisions, on board desalination system, survival suits with heater ducts, fishing gear and other essential supplies. The AMV apparatus 3.0 operator is capable of monitoring the vital signs of the occupants through wrist or ankle straps contained within the survival suits. The vital signs wrist or ankle straps can detached and simply fastened about a body appendage in warmer climates where survival suits are not necessary.

The AMV apparatus 3.0 is also capable of traversing a burning patch of oil through use of a peripheral water spray system and fireproof materials which enable the vehicle to transit otherwise lethal heat and smoke environments for short periods of time to effect rescue of a person in peril.

The AMV apparatus 3.0 is capable of traversing more than four hundred miles over a four day period, depending on weather condition, in order to conduct the occupants to safe haven or towards a rescue vessel or helicopter where extraction of the occupants and removal of the AMV apparatus 3.0 can be accomplished. The vehicle weather hood has clear non-flammable viewing ports recessed into the fabric or rigid material in order to enable the occupants to steer the vehicle through a direct control pad hardwired to the control navigation and collision avoidance system 3F.

The AMV apparatus 3.0 can also have the inflatable hull and weather hood assembly 3B removed in order to accommodate a rigid weather hood assembly 3C for offshore oil rig deployment where the recovery of men overboard may demand a more ruggedized product.

Should recovery of the AMV apparatus 3.0 prove difficult in certain weather situations, the AMV apparatus 3.0 is capable of relaying its geographic position for more than two years through long life lithium batteries, and through a continuous recharging solar array and marine lead acid or other rechargeable batteries.

CONCLUSION

The reader will see that the rescue system and apparatus of the present invention provides a highly valuable survival package that can be used in search and rescue applications. The present invention can be deployed by air, land or sea to marine victims with means to specifically detect, target, manipulate, monitor, and communicate with the victims or persons in peril. The rescue system may be used in conditions too dangerous to endanger additional human lives including zero-visibility condition, or conditions of intense heat or hostile weapons fire.

While the above description contains many specificities, these should not be construed as limitations on the scope of the invention, but rather as an exemplification of one preferred embodiment thereof. Many other variations are possible. Accordingly, the scope of the invention should be determined not by the embodiments illustrated, but by the appended claims and their legal equivalents.

I claim:

1. A marine personnel rescue system and apparatus for rescuing persons in peril comprising:

(a) an autonomous marine vehicle apparatus comprising:
- a rigid hull shaped to form a concavity having first and second sides, the two sides being joined by a bow and a stern, and having an upper periphery around the first and second sides, and the bow and stern, the concavity forming an interior and an exterior, the interior forming an interior hull surface and forming at least one interior chamber;
- a first and second foldable rigid hull wings hingedly attached to the first and second sides of the rigid hull;
- an inflatable hull and weather hood assembly adhesively attached to the upper periphery of the rigid hull and the foldable rigid hull wings and forming an interior cabin space, the interior cabin space being defined by a generally vertical sidewall having a top, the generally vertical sidewall also having an interior hood surface and an exterior surface;
- a power pack means attached to the interior hull surface in one interior chamber of the rigid hull;
- a propulsion means coupled to the power pack means;
- means for control including navigation and collision avoidance;
- means for communication to and from the persons in peril;
- means for electrical generation;
- means for compressing air;
- means for storing compressed air;
- transom means;

(b) a personnel recovery means, proximately secured to the transom means of the autonomous marine vehicle apparatus, for recovery of the persons in peril;

(c) a targeting and sensor array means for detecting the persons in peril;

(d) a sensor array control means for controlling the targeting and sensor array means; and (e) a deployment means for launching the autonomous marine vehicle apparatus.

2. The marine personnel rescue system and apparatus as specified in claim one further comprising:

(a) means for desalination of salt water;

(b) means for storing fresh water;

(c) means for sensing water quality; and (d) means for fire protection.

3. The marine personnel rescue system and apparatus as specified in claim one further comprising:

(a) at least one bulkhead having a top edge positioned transversely to the first and second sides of the rigid hull forming at least two chambers interior;

(b) a deck panel having at least one opening connected to the top edge of the bulkhead and contiguous with and connected to the upper periphery of the rigid hull, the deck panel forming the interior of the rigid hull into an enclosed cavity below;

(c) sealing means for making the enclosed cavity below watertight;

(d) at least one towing eyelet attached to the rigid hull.

4. The marine personnel rescue system and apparatus as specified in claim one further comprising:

(a) at least one window means, positioned on the generally vertical sidewall of the inflatable hull and weather hood assembly, for outside visibility from the interior cabin;

(b) access means for personnel ingress and egress into the inflatable hull and weather hood assembly;

(c) window flap means for covering the window means;

(d) access flap means for covering the access means;

(e) sealing means for window flap means;

(f) sealing means for access flap means; and (g) grab ropes mounted to the exterior surface of the inflatable hull and weather hood surface.

5. The marine personnel rescue system and apparatus as specified in claim one wherein the inflatable hull and weather hood assembly is generally comprised of a fireproof material.

6. The marine personnel rescue system and apparatus as specified in claim one wherein the power pack means comprises:

(a) at least one fuel supply reservoir positioned and mounted in the interior chamber of the rigid hull;

(b) an internal combustion engine positioned and mounted in the interior chamber of the rigid hull and operably connected to the fuel supply reservoir by a connecting tube;

(c) a remote air intake port, positioned so as to intake a minimal amount of water, operably connected to internal combustion engine by an air supply tube;

(d) separation means, operably connected between the remote air intake port and the internal combustion engine, for separating air and water; and (e) means for one-way exhaust from the internal combustion engine.

7. The marine personnel rescue system and apparatus as specified in claim one wherein the propulsion means comprises at least one propulsion thruster assembly rotatably coupled to the power pack means.

8. The marine personnel rescue system and apparatus as specified in claim one wherein the means for control including navigation and collision avoidance comprise:

(a) a CPU computer module housing disposed within the interior cabin space;

(a1) a CPU computer module disposed within the CPU computer module housing;

(b) an ARGOS satellite store and transmit data telemetry card disposed within the CPU computer module housing;

(c) a STARSYS/INMARSAT/IRRIDIUM two-way satellite card disposed within the CPU computer module housing;

(d) a GPS satellite dynamic self positioning and tracking card disposed within the CPU computer module housing;

(e) a thermal sensor signal processing card disposed within the CPU computer module housing;

(f) an audio signal processing card disposed within the CPU computer module housing;

(g) means for computer memory storage disposed within the CPU computer module housing;

(h) means for two-way RF data and voice transceiver communication electrically connected to the CPU computer module housing;

(i) means for sonar depth sounding;

(j) means for radar sensing; and (k) software means for expert system control of autonomous marine vehicle apparatus.

9. The marine personnel rescue system and apparatus as specified in claim one wherein the means for communication to and from the persons in peril comprise:

(a) a rigid antenna housing attached to the top of the inflatable hull and weather hood assembly, the rigid antenna housing having a top surface and a bottom surface, the top surface being external to the autonomous marine vehicle apparatus and the bottom surface being internal to the autonomous marine vehicle apparatus;

(b) a photovoltaic cell array operably mounted to the external surface of the rigid antenna housing;

(c) antenna means for transmitting telemetry data operably mounted to the external surface of the rigid antenna housing;

(d) means for two-way audio communication operably mounted to the internal surface of the rigid antenna housing; and (e) means for two-way video communication operably mounted to the internal surface of the rigid antenna housing.

10. The marine personnel rescue system and apparatus as specified in claim 9 wherein the rigid antenna housing further comprises:

(a) means for lifting by helicopter attached to the exterior of rigid antenna housing;

(b) means for securing a rigid support weight transfer device;

(c) video camera means operably mounted to the external surface of the rigid antenna housing;

(d) lighting means operably mounted to the external surface of the rigid antenna housing;

(e) lighting means operably mounted to the internal surface of the rigid antenna housing;

(f) self righting means operably mounted to the external surface of the rigid antenna housing;

(g) radome antenna housing means operably mounted to external surface of the rigid antenna housing;

(h) means for LCD video display operably mounted to the internal surface of the rigid antenna housing;

(i) means for sensing audio signals operably mounted to the external surface of the rigid antenna housing;

(j) means for sensing thermal-infra red operably mounted to the external surface of the rigid antenna housing;

(k) means for washing operably mounted to the external surface of the rigid antenna housing; and (l) megaphone means operably mounted to the external surface of the rigid antenna housing.

11. The marine personnel rescue system and apparatus as specified in claim one wherein the personnel recovery means comprises:

(a) a hydraulic pump means positioned and operably mounted in the interior chamber of the rigid hull;

(b) a hydraulically extendible cylinder arm assembly rotatably attached to the stern of the rigid hull assembly, the hydraulically extendible cylinder arm assembly being operably connected to the hydraulic pump means by hydraulic tubing;

(c) an inflatable recovery chute attached to and surrounding the hydraulically extendible cylinder arm assembly, the inflatable recovery chute being operably connected to the air compressor means by air tubing; and (d) a recovery chute rapid inflation lift bag attached below and to the inflatable recovery chute, the recovery chute rapid inflation lift bag being operably connected to the means for storing compressed air by air tubing.

12. The marine personnel rescue system and apparatus as specified in claim one wherein the targeting and sensor array means comprises:

(a) a mounting pylon disposed within the vicinity of the person in peril;

(b) a Sensar tube mounting rack generally vertically rotatably coupled to the mounting pylon, the Sensar tube mounting rack having at least one generally horizontal Sensar tube mounting platform rotatably coupled to the Sensar tube mounting rack;

(c) at least one Sensar tube attached to the horizontal Sensar tube mounting platform;

(d) a stepper motor means, operably coupled to the Sensar tube mounting rack, for effecting rotation of the Sensar tube mounting rack in the generally vertical plane;

(e) a stepper motor means, operably coupled to the horizontal Sensar tube mounting platform, for effecting rotation of the Sensar tube mounting platform in the generally horizontal plane;

(f) at least one sensor operably mounted internal to the Sensar tube, the sensor receiving sensed data from the vicinity of the person in peril;

(g) means for electrically transmitting the sensed data to the sensory array control means; and (h) means for electrically receiving control data from the sensor array control means.

13. The marine personnel rescue system and apparatus as specified in claim one wherein the sensor array control means comprises:

(a) means for receiving data from the targeting and sensor array means;

(b) means for processing the received data;

(c) means for effecting control of the targeting and sensor array means; and (d) means for electrically transmitting control data to the targeting and sensor array means.

14. The marine personnel rescue system and apparatus as specified in claim one wherein the deployment means for launching the autonomous marine vehicle apparatus comprises:

(a) a deployment casing enclosing the autonomous marine vehicle apparatus; and (b) a launch means removably contacting and guiding the deployment casing.

15. The marine personnel rescue system and apparatus as specified in claim fourteen wherein the deployment casing is generally prolate in shape, comprising:

(a) a rear cone section;

(b) a forward section demountably attached to the rear cone section;

(c) actuator means for separating the rear cone section from the forward section; and (d) means for mounting to aircraft.

16. The marine personnel rescue system and apparatus as specified in claim fourteen wherein the deployment casing is generally prolate in shape, comprising:

(a) a top casing section;

(b) a bottom casing section demountably attached to the top casing section; and (c) means for separating the top casing section from the bottom casing section.

17. The marine personnel rescue system and apparatus as specified in claim fourteen wherein the launch means comprises deployment from an externally-mounted air deployment apparatus.

18. The marine personnel rescue system and apparatus as specified in claim fourteen wherein the launch means comprises deployment from an internally-mounted air deployment apparatus.

19. The marine personnel rescue system and apparatus as specified in claim fourteen wherein the launch means comprises a shore-mounted launch deployment apparatus.

20. The marine personnel rescue system and apparatus as specified in claim fourteen wherein the launch means comprises an oil rig mounted launch apparatus.

21. The marine personnel rescue system and apparatus as specified in claim fourteen wherein the launch means comprises a ship mounted launch apparatus.

22. The marine personnel rescue system and apparatus as specified in claim seventeen wherein the externally-mounted air deployment apparatus comprises a Ter-7 triple ejector bomb rack.

23. The marine personnel rescue system and apparatus as specified in claim seventeen wherein the externally-mounted air deployment apparatus comprises a BRU-11 bomb rack.

* * * * *